US009464542B2

(12) United States Patent
Numakura et al.

(10) Patent No.: US 9,464,542 B2
(45) Date of Patent: Oct. 11, 2016

(54) VARIABLE VALVE TIMING APPARATUS FOR INTERNAL COMBUSTION ENGINE

(75) Inventors: Masaki Numakura, Toyota (JP); Yuu Yokoyama, Okazaki (JP); Yoshiro Kamo, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 481 days.

(21) Appl. No.: 13/258,861

(22) PCT Filed: Apr. 12, 2010

(86) PCT No.: PCT/IB2010/000800

§ 371 (c)(1),
(2), (4) Date: Sep. 22, 2011

(87) PCT Pub. No.: WO2010/119322

PCT Pub. Date: Oct. 21, 2010

(65) Prior Publication Data

US 2012/0017859 A1 Jan. 26, 2012

(30) Foreign Application Priority Data

Apr. 13, 2009 (JP) ..... 2009-097288

(51) Int. Cl.
*F01L 1/34* (2006.01)
*F01L 1/344* (2006.01)

(52) U.S. Cl.
CPC ..... *F01L 1/3442* (2013.01)

(58) Field of Classification Search
CPC ..... F01L 1/344; F01L 2001/34463; F01L 2001/34426
See application file for complete search history.

(56) References Cited

U.S. PATENT DOCUMENTS 6,505,586 B1 1/2003 Sato et al.
6,684,835 B2 * 2/2004 Komazawa et al. ..... 123/90.17
(Continued)

FOREIGN PATENT DOCUMENTS

DE 102 28 832 A1 1/2003
EP 1 672 184 A1 6/2006
(Continued)

OTHER PUBLICATIONS

International Search Report in International Application No. PCT/IB2010/000800; Jul. 5, 2010.
(Continued)

*Primary Examiner* — Thomas Denion
*Assistant Examiner* — Daniel Bernstein
(74) *Attorney, Agent, or Firm* — Oliff PLC

(57) ABSTRACT

A variable valve timing apparatus includes: a variable valve timing mechanism; an intermediate locking mechanism that locks the valve timing at an intermediate timing; and a hydraulic pressure supply device that hydraulically actuates these mechanisms. The hydraulic pressure supply device uses a single oil control valve to control a state where lubricating oil is supplied to or drained from each of an advance chamber, a retard chamber and an intermediate chamber of an intermediate locking mechanism. The oil control valve has first to fourth modes. The oil control valve advances the valve timing and actuates the intermediate locking mechanism in a projecting direction in the third mode, and, under a situation that the amount of lubricating oil supplied to the variable valve timing mechanism is smaller than that in the third mode, advances the valve timing and actuates the intermediate locking mechanism in a release direction in the fourth mode.

19 Claims, 16 Drawing Sheets

(56) References Cited

U.S. PATENT DOCUMENTS

| | | | | |
|---|---|---|---|---|
| 6,976,460 | B2 * | 12/2005 | Komazawa et al. | 123/90.15 |
| 7,444,964 | B2 * | 11/2008 | Kanada et al. | 123/90.15 |
| 8,356,583 | B2 * | 1/2013 | Smith | 123/90.17 |
| 2003/0010303 | A1 | 1/2003 | Kanada et al. | |
| 2009/0025668 | A1 | 1/2009 | Matsusaka et al. | |

FOREIGN PATENT DOCUMENTS

| | | |
|---|---|---|
| EP | 1 672 187 A1 | 6/2006 |
| JP | A-2001-050064 | 2/2001 |
| JP | A-2001-221019 | 8/2001 |
| JP | A-2001-227308 | 8/2001 |
| JP | A-2002-122009 | 4/2002 |
| JP | A-2003-013714 | 1/2003 |
| JP | A-2003-172110 | 6/2003 |
| JP | A-2006-144766 | 6/2006 |
| JP | A-2006-170024 | 6/2006 |
| JP | A-2006-170026 | 6/2006 |
| JP | A-2007-127046 | 5/2007 |
| JP | A-2010-127252 | 6/2010 |
| JP | A-2010-163942 | 7/2010 |

OTHER PUBLICATIONS

Written Opinion of the International Searching Authority in International Application No. PCT/IB2010/000800; Jul. 5, 2010.

Japanese Office Action in Japanese Patent Application No. 2009-097228; dated Jan. 18, 2011 (with partial English-language translation).

* cited by examiner

FIG.3A MOST ADVANCED TIMING INVTmax
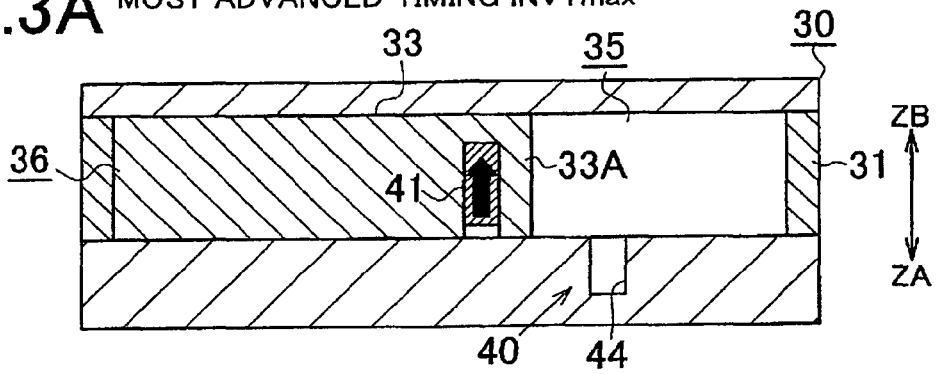
FIG.3B MOST RETARDED TIMING INVTmin
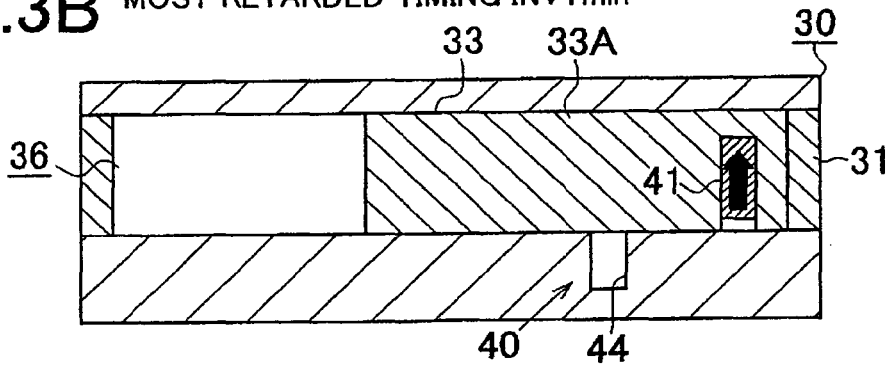
FIG.3C INTERMEDIATE TIMING INVTmdl
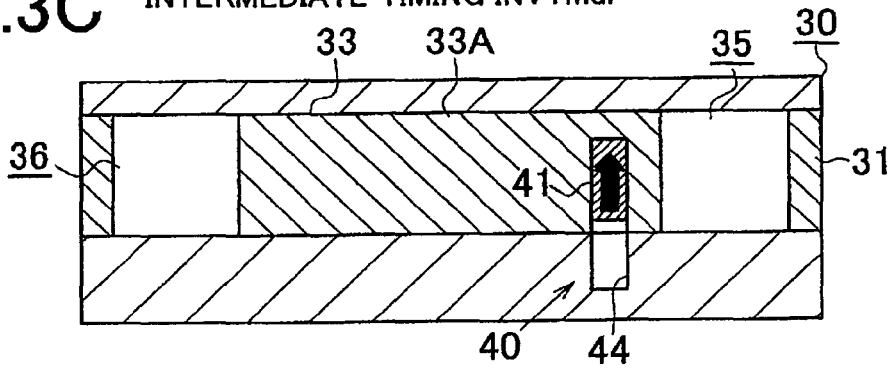
FIG.3D DURING INTERMEDIATE LOCKING
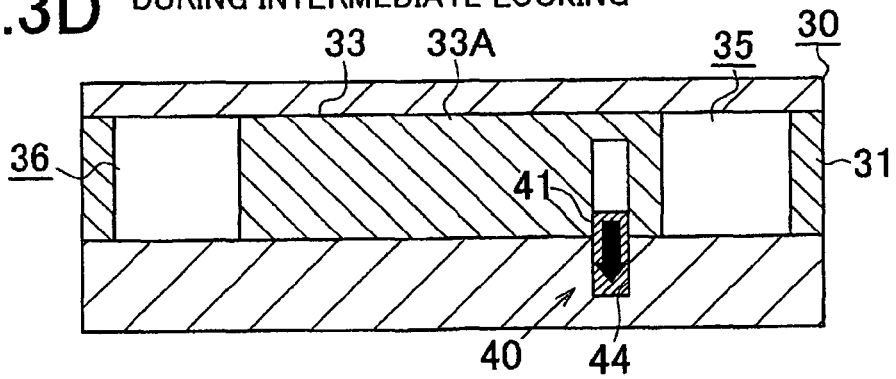

FIG.6A FIRST MODE
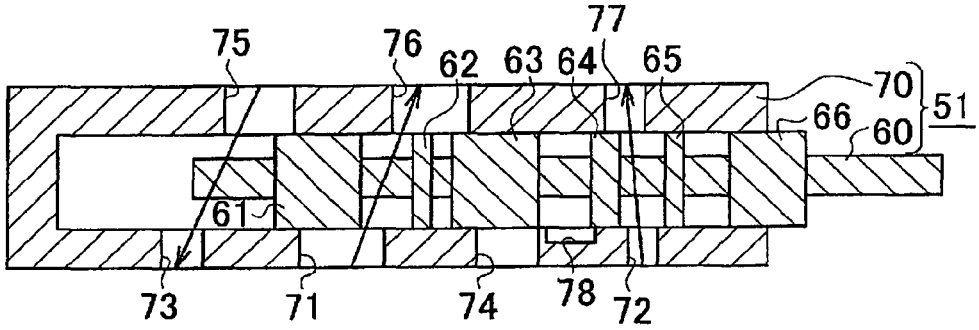
FIG.6B SECOND MODE
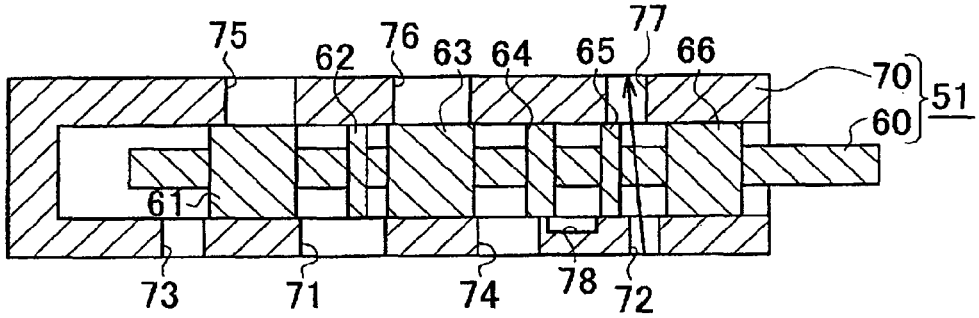
FIG.6C THIRD MODE
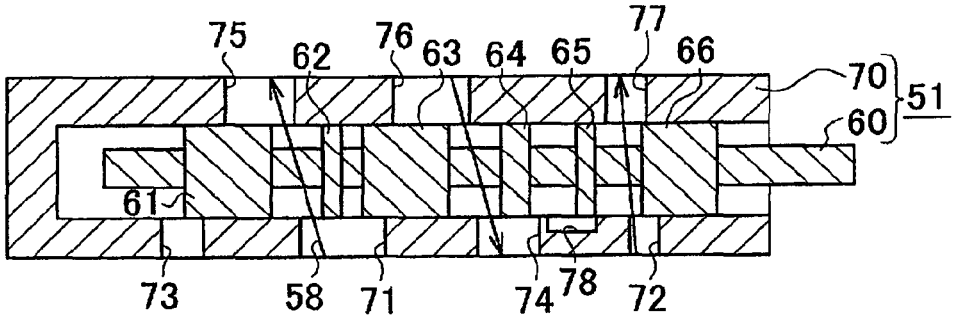
FIG.6D FOURTH MODE
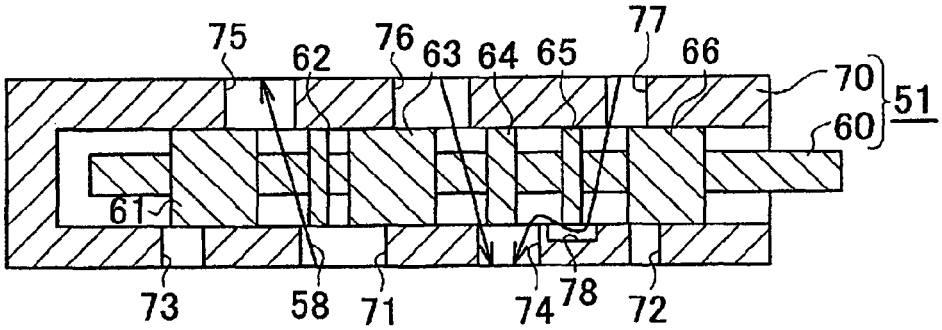

ADVANCE PORT

RETARD PORT

INTERMEDIATE PORT

FIG. 8A

RELATIONSHIP BETWEEN OPERATION MODE AND LUBRICATING OIL SUPPLY MODE

| | FIRST MODE | SECOND MODE | THIRD MODE | FOURTH MODE |
|---|---|---|---|---|
| ADVANCE CHAMBER | DRAIN | CLOSE | SUPPLY | SUPPLY AT LOW FLOW RATE |
| RETARD CHAMBER | SUPPLY | CLOSE | DRAIN | DRAIN |
| INTERMEDIATE CHAMBER | SUPPLY | | | DRAIN |

FIG. 8B

RELATIONSHIP BETWEEN OPERATION MODE AND MODE IN WHICH VVT OR LOCK PIN IS OPERATED

| | FIRST MODE | SECOND MODE | THIRD MODE | FOURTH MODE |
|---|---|---|---|---|
| VVT | RETARD | HOLD | ADVANCE | ADVANCE AT LOW RATE OF CHANGE |
| LOCK PIN | ACCOMMODATE | | | PROJECT |

FIG. 8C

RELATIONSHIP BETWEEN ENGINE OPERATING STATE AND OPERATION MODE

| | OPERATION MODE |
|---|---|
| WHEN ENGINE IS STARTED | FOURTH MODE |
| WHEN INTERMEDIATE LOCKING IS RELEASED | FOURTH MODE ⇒ SECOND MODE |
| WHEN ENGINE IS NORMALLY OPERATED | FIRST MODE ⇔ SECOND MODE ⇔ THIRD MODE |
| WHEN ENGINE IS AT IDLE OR STOPPED | ONE OF FIRST TO THIRD MODES ⇒ FOURTH MODE |

FIG.11A FIRST MODE
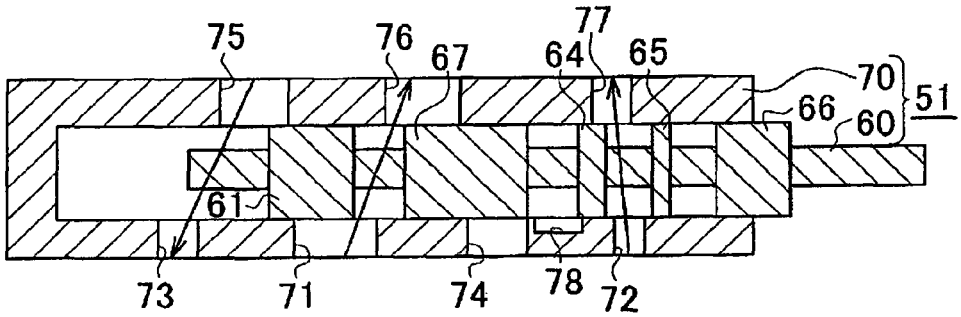
FIG.11B SECOND MODE
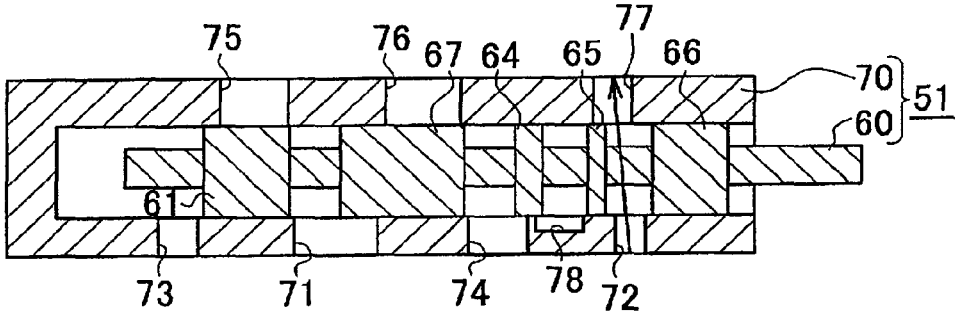
FIG.11C THIRD MODE
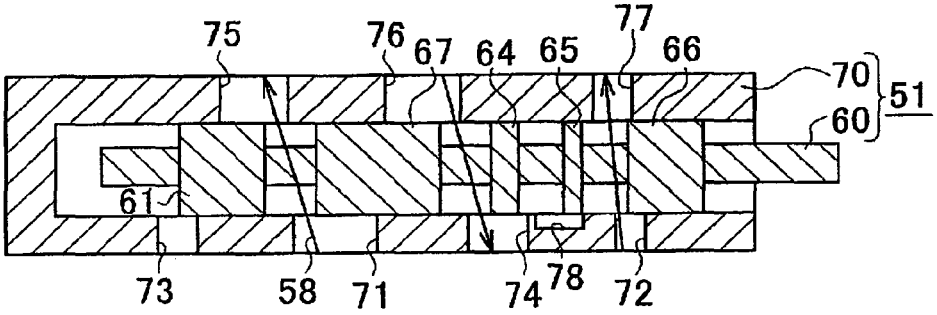
FIG.11D FOURTH MODE
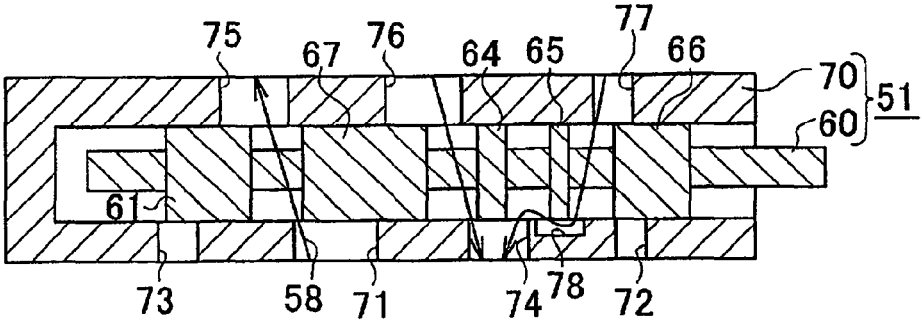

FIG.12A FIRST MODE
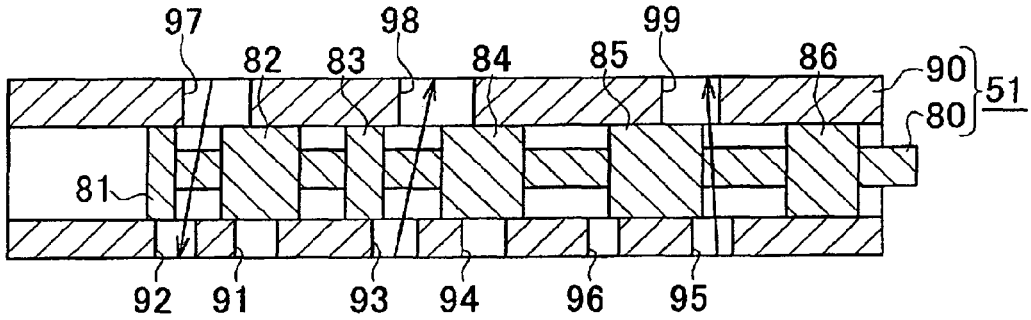
FIG.12B SECOND MODE
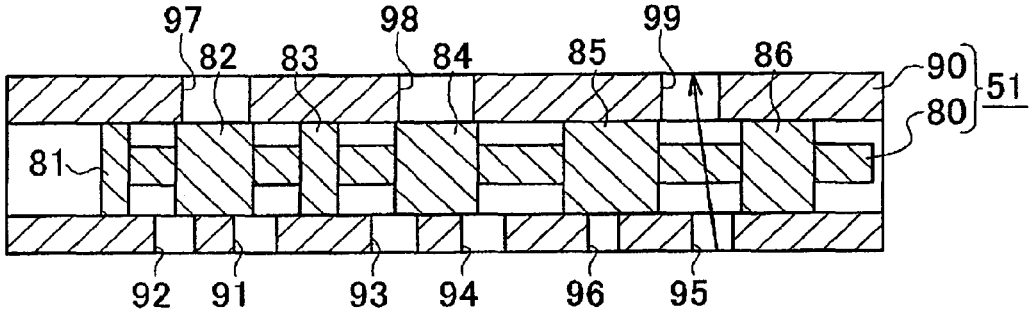
FIG.12C THIRD MODE
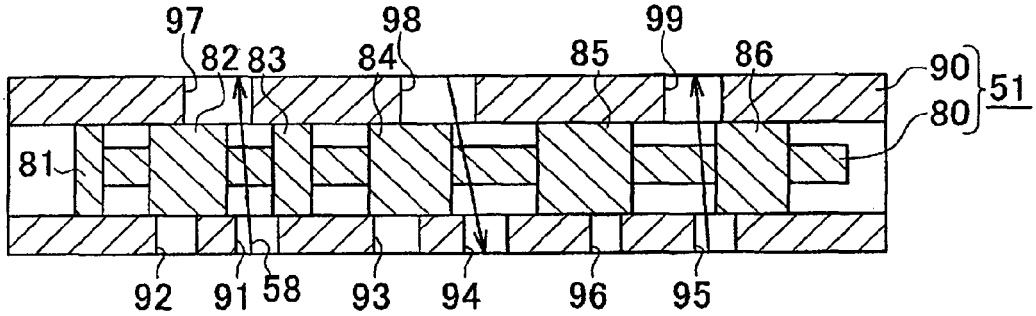
FIG.12D FOURTH MODE
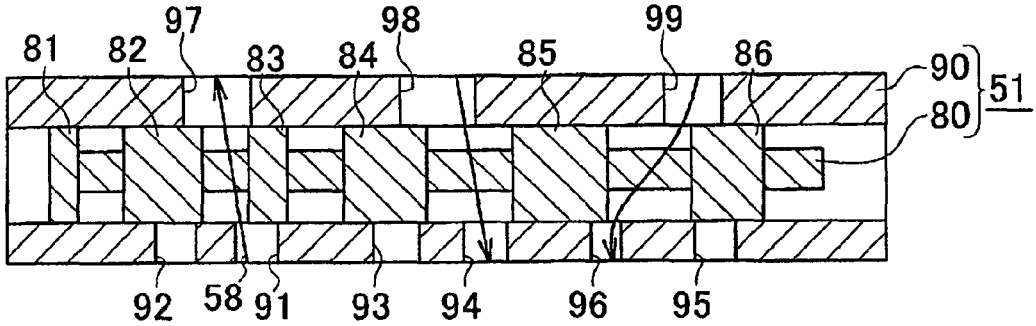

FIG.14A FIFTH MODE
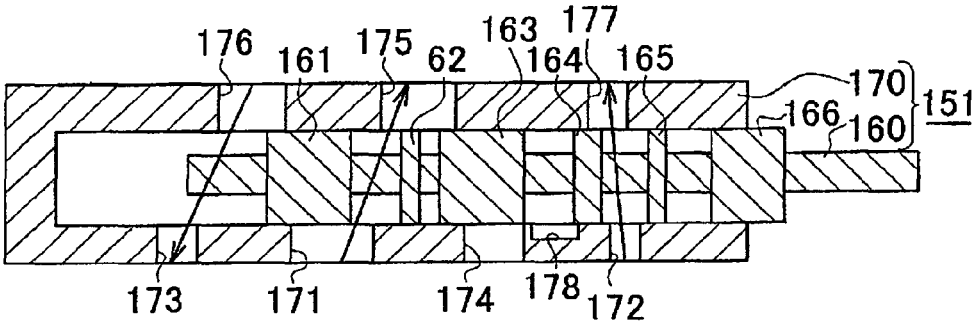
FIG.14B SIXTH MODE
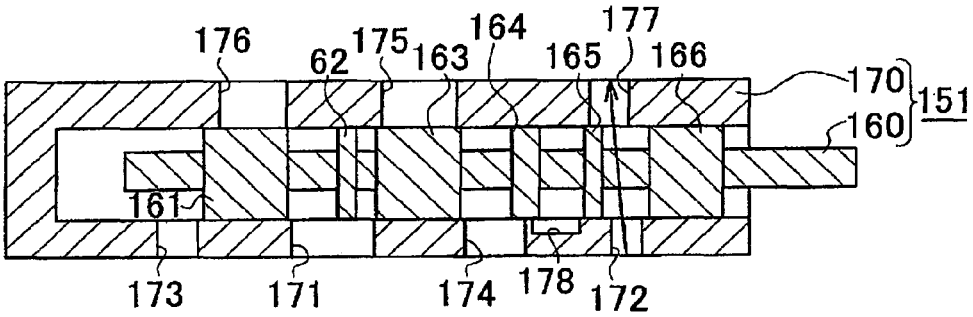
FIG.14C SEVENTH MODE
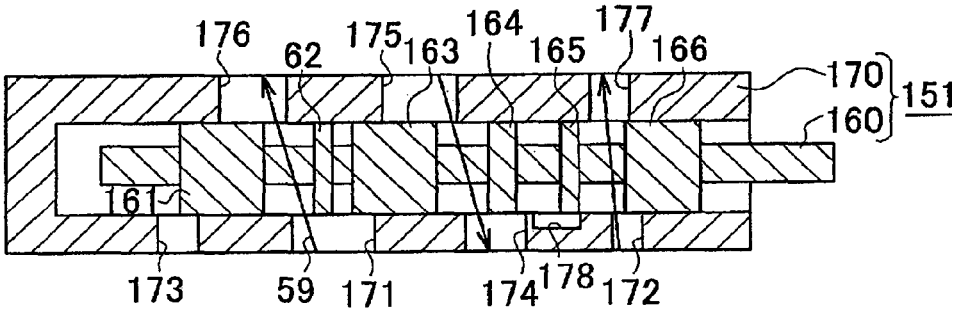
FIG.14D EIGHTH MODE
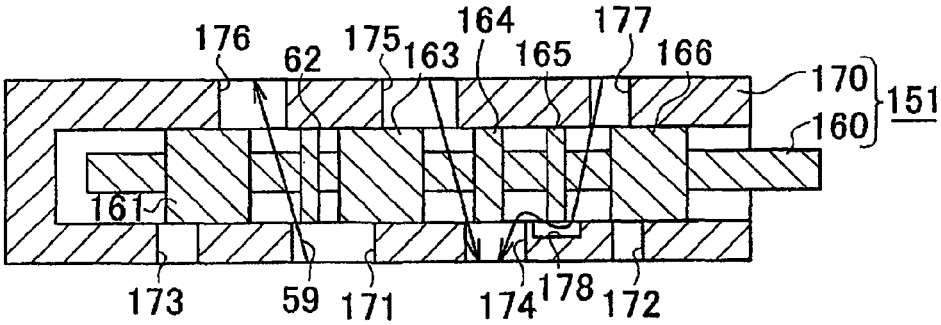

FIG. 15A

RELATIONSHIP BETWEEN OPERATION MODE AND LUBRICATING OIL SUPPLY MODE

| | FIFTH MODE | SIXTH MODE | SEVENTH MODE | EIGHTH MODE |
|---|---|---|---|---|
| ADVANCE CHAMBER | SUPPLY | CLOSE | DRAIN | DRAIN |
| RETARD CHAMBER | DRAIN | CLOSE | SUPPLY | SUPPLY AT LOW FLOW RATE |
| INTERMEDIATE CHAMBER | SUPPLY | | | DRAIN |

FIG. 15B

RELATIONSHIP BETWEEN OPERATION MODE AND MODE IN WHICH VVT OR LOCK PIN IS OPERATED

| | FIFTH MODE | SIXTH MODE | SEVENTH MODE | EIGHTH MODE |
|---|---|---|---|---|
| VVT | ADVANCE | HOLD | RETARD | RETARD AT LOW RATE OF CHANGE |
| LOCK PIN | ACCOMMODATE | | | PROJECT |

FIG. 15C

RELATIONSHIP BETWEEN ENGINE OPERATING STATE AND OPERATION MODE

| | OPERATION MODE |
|---|---|
| WHEN ENGINE IS STARTED | EIGHTH MODE |
| WHEN INTERMEDIATE LOCKING IS RELEASED | EIGHTH MODE ⇒ SIXTH MODE |
| WHEN ENGINE IS NORMALLY OPERATED | FIFTH MODE ⇔SIXTH MODE ⇔ SEVENTH MODE |
| WHEN ENGINE IS AT IDLE OR STOPPED | ONE OF FIFTH TO SEVENTH MODES ⇒ EIGHTH MODE |

VARIABLE VALVE TIMING APPARATUS FOR INTERNAL COMBUSTION ENGINE

BACKGROUND OF THE INVENTION

1. Field of the Invention

The invention relates to a variable valve timing apparatus for an internal combustion engine, which includes a variable valve timing mechanism that changes the valve timing, a phase locking mechanism that locks the valve timing at an intermediate timing between the most advanced timing and the most retarded timing, and a hydraulic pressure control mechanism that hydraulically actuates these variable valve timing mechanism and the phase locking mechanism.

2. Description of the Related Art

The variable valve timing apparatus is, for example, known as the one described in Japanese Patent Application Publication No. 2001-50064 (JP-A-2001-50064). As is described in the paragraphs [0035] to [0043] and FIG. 3 to FIG. 6 of JP-A-2001-50064, the variable valve timing apparatus includes a variable valve timing mechanism, a phase locking mechanism and a hydraulic pressure control mechanism. The variable valve timing mechanism changes the valve timing of an intake valve between the most advanced timing and the most retarded timing. The phase locking mechanism locks the valve timing of the intake valve at an intermediate timing between the most advanced timing and the most retarded timing. The hydraulic pressure control mechanism hydraulically actuates these variable valve timing mechanism and phase locking mechanism.

In addition, the phase locking mechanism is formed of an intermediate chamber, a restricting member and a restricting hole. The intermediate chamber is in fluid communication with retard chambers of the variable valve timing mechanism. The restricting member is provided for an output rotor and is displaced with respect to the output rotor between a lock position and a release position. The restricting hole is formed in an input rotor. The restricting member can be fitted into the restricting hole. In addition, the hydraulic pressure control mechanism includes a single control valve that supplies or drains lubricating oil (working oil) to or from each of the variable valve timing mechanism and the phase locking mechanism.

Then, when the relative rotational phase between the input rotor and output rotor of the variable valve timing mechanism corresponds to the intermediate valve timing, and when lubricating oil is supplied to the intermediate chamber via one of the retard chambers by the control valve, the restricting member projects from the output rotor and is displaced to the lock position. Thus, a relative rotation between the input rotor and the output rotor is restricted to lock the valve timing at the intermediate timing. On the other hand, when the relative rotational phase between the input rotor and output rotor of the variable valve timing mechanism corresponds to the intermediate valve timing, and when lubricating oil is drained from the intermediate chamber via the one of the retard chambers by the control valve, the restricting member withdraws from the restricting hole and is displaced to the release position. Thus, the restriction of a relative rotation between the input rotor and the output rotor is removed to allow the valve timing to be changed.

Incidentally, in the variable valve timing apparatus, the valve timing is locked by the phase locking mechanism only when the engine is stopped; however, in order to further, effectively take advantage of the function of the phase locking mechanism, it may be desirable that the valve timing can be locked during operation of the engine as well. However, the variable valve timing apparatus is formed so that one of the retard chambers is in fluid communication with the intermediate chamber. Therefore, in order to lock the valve timing during operation of the engine, it is necessary to drain lubricating oil from the retard chambers, that is, to set the operation mode of the control valve to an advance mode. On the other hand, the advance mode premises to respond to an advance request based on an engine operating state in normal valve timing control, so the rate of change in the valve timing is high when the advance mode is selected. Therefore, when the advance mode is selected as the mode of the control valve in order for the phase locking mechanism to lock the valve timing, the restricting member may not be fitted into the restricting hole but may pass by the restricting hole. Thus, the valve timing may not be appropriately locked by the phase locking mechanism.

Then, to solve the above problem, it is conceivable that both a control valve for the variable valve timing mechanism and a control valve for the phase locking mechanism are provided and then these control valves are separately controlled. However, in this case, two control valves are required, so it may not be desirable in terms of practical use.

SUMMARY OF THE INVENTION

The invention provides a variable valve timing apparatus for an internal combustion engine, which is able to control a variable valve timing mechanism and a phase locking mechanism using a single control valve and also to accurately lock the valve timing using the phase locking mechanisms.

A first aspect of the invention provides a variable valve timing apparatus for an internal combustion engine. The variable valve timing apparatus includes: a variable valve timing mechanism that changes a valve timing of an engine valve between a most advanced timing and a most retarded timing; a phase locking mechanism that locks the valve timing of the engine valve at an intermediate timing between the most advanced timing and the most retarded timing; and a hydraulic pressure control mechanism that hydraulically actuates these variable valve timing mechanism and phase locking mechanism, wherein the phase locking mechanism is displaced to a lock position to lock the valve timing at the intermediate timing when the valve timing is the intermediate timing and a state where working oil is supplied to or drained from the phase locking mechanism by the hydraulic pressure control mechanism is a first supply/drain state, and the phase locking mechanism is displaced to a release position to unlock the valve timing when the valve timing is the intermediate timing and the state where working oil is supplied or drained by the hydraulic pressure control mechanism is a second supply/drain state, the hydraulic pressure control mechanism uses a single control valve to control a state where working fluid is supplied to or drained from each of an advance chamber of the variable valve timing mechanism, a retard chamber of the variable valve timing mechanism and the phase locking mechanism, the single control valve actuates the variable valve timing mechanism in a timing advance direction and maintains the state, where working oil is supplied to or drained from the phase locking mechanism, in the second supply/drain state in a first operation mode, and the single control valve actuates the variable valve timing mechanism in the timing advance direction and maintains the state, where working oil is supplied to or drained from the phase locking mechanism, in the first supply/drain state in a second operation mode under a situation that an amount of working oil supplied to the advance chamber of the variable valve timing mechanism is smaller than that in the first operation mode. The engine valve may be one of an intake valve and an exhaust valve.

With the above aspect, the above first operation mode and second operation mode are prepared as the operation mode of the control valve. Therefore, when it is required to lock the valve timing at the intermediate timing, the control valve is maintained in the second operation mode to thereby make it possible to prevent a situation that the valve timing is not locked by the phase locking mechanism because of the rate of change at which the variable valve timing mechanism is advanced. That is, it is possible to achieve both controlling the variable valve timing mechanism and the phase locking mechanism with the single control valve and accurately locking the valve timing with the phase locking mechanism.

In the variable valve timing apparatus for an internal combustion engine, an advance chamber flow passage that supplies working oil to the advance chamber of the variable valve timing mechanism may be formed in the single control valve in any one of the first operation mode and the second operation mode, and a flow rate of working oil in the advance chamber flow passage formed in the second operation mode may be lower than a flow rate of working oil in the advance chamber flow passage formed in the first operation mode, whereby an amount of working oil supplied to the advance chamber of the variable valve timing mechanism may be varied between the first operation mode and the second operation mode.

In the variable valve timing apparatus for an internal combustion engine, the single control valve may include a sleeve having a plurality of ports and a spool having a plurality of valve elements, and respective opening areas of the plurality of ports may be varied by the corresponding valve elements among the plurality of valve elements as these sleeve and spool are relatively displaced, in any one of the first operation mode and the second operation mode, among the plurality of ports, an advance port that is connected to the advance chamber of the variable valve timing mechanism and a supply port that supplies working oil may be in fluid communication with each other, and an opening area of one of the advance port and the supply port in the second operation mode may be smaller than an opening area of one of the advance port and the supply port in the first operation mode, whereby a flow rate of working fluid in the advance chamber flow passage may be varied between the first operation mode and the second operation mode.

In the variable valve timing apparatus for an internal combustion engine, the single control valve may actuate the variable valve timing mechanism in a timing retard direction and may maintain the state, where working oil is supplied to or drained from the phase locking mechanism, in the second supply/drain state in a third operation mode, and, when there is a request to lock the valve timing at the intermediate timing and the valve timing at that time is advanced with respect to the intermediate timing, the variable valve timing apparatus may maintain an operation mode of the control valve in the third operation mode to change the valve timing to be retarded with respect to the intermediate timing and then may maintain the operation mode of the control valve in the second operation mode to advance the valve timing.

In the variable valve timing apparatus for an internal combustion engine, when there is a request to lock the valve timing at the intermediate timing and the valve timing at that time is retarded with respect to the intermediate timing, the variable valve timing apparatus may maintain an operation mode of the control valve in the second operation mode to advance the valve timing.

A second aspect of the invention provides a variable valve timing apparatus for an internal combustion engine. The variable valve timing apparatus includes: a variable valve timing mechanism that changes a valve timing of an engine valve between a most advanced timing and a most retarded timing; a phase locking mechanism that locks the valve timing of the engine valve at an intermediate timing between the most advanced timing and the most retarded timing; and a hydraulic pressure control mechanism that hydraulically actuates these variable valve timing mechanism and phase locking mechanism, wherein the phase locking mechanism is displaced to a lock position to lock the valve timing at the intermediate timing when the valve timing is the intermediate timing and a state where working oil is supplied to or drained from the phase locking mechanism by the hydraulic pressure control mechanism is a first supply/drain state, and the phase locking mechanism is displaced to a release position to unlock the valve timing when the valve timing is the intermediate timing and the state where working oil is supplied or drained by the hydraulic pressure control mechanism is a second supply/drain state, the hydraulic pressure control mechanism uses a single control valve to control a state where working fluid is supplied to or drained from each of an advance chamber of the variable valve timing mechanism, a retard chamber of the variable, valve timing mechanism and the phase locking mechanism, the single control valve actuates the variable valve timing mechanism in a timing retard direction and maintains the state, where working oil is supplied to or drained from the phase locking mechanism, in the second supply/drain state in a fourth operation mode, and the single control valve actuates the variable valve timing mechanism in the timing retard direction and maintains the state, where working oil is supplied to or drained from the phase locking mechanism, in the first supply/drain state in a fifth operation mode under a situation that an amount of working oil supplied to the retard chamber of the variable valve timing mechanism is smaller than that in the fourth operation mode. The engine valve may be one of an intake valve and an exhaust valve.

With the above aspect, the above fourth operation mode and fifth operation mode are prepared as the operation mode of the control valve. Therefore, when it is required to lock the valve timing at the intermediate timing, the control valve is maintained in the fifth operation mode to thereby make it possible to prevent a situation that the valve timing is not locked by the phase locking mechanism because of the rate of change at which the variable valve timing mechanism is retarded. That is, it is possible to achieve both controlling the variable valve timing mechanism and the phase locking mechanism with the single control valve and accurately locking the valve timing with the phase locking mechanism.

In the variable valve timing apparatus for an internal combustion engine, a retard chamber flow passage that supplies working oil to the retard chamber of the variable valve timing mechanism may be formed in the single control valve in any one of the fourth operation mode and the fifth operation mode, and a flow rate of working oil in the retard chamber flow passage formed in the fifth operation mode may be lower than a flow rate of working oil in the retard chamber flow passage formed in the fourth operation mode, whereby an amount of working oil supplied to the retard chamber of the variable valve timing mechanism may be varied between the fourth operation mode and the fifth operation mode.

In the variable valve timing apparatus for an internal combustion engine, the single control valve may include a sleeve having a plurality of ports and a spool having a plurality of valve elements, and respective opening areas of the plurality of ports may be varied by the corresponding valve elements among the plurality of valve elements as these sleeve and spool are relatively displaced, in any one of the fourth operation mode and the fifth operation mode, among the plurality of ports, a retard port that is connected to the retard chamber of the variable valve timing mechanism and a supply port that supplies working oil may be in fluid communication with each other, and an opening area of one of the retard port and the supply port in the fifth operation mode may be smaller than an opening area of one of the retard port and the supply port in the fourth operation mode, whereby a flow rate of working fluid in the retard chamber flow passage may be varied between the fourth operation mode and the fifth operation mode.

In the variable valve timing apparatus for an internal combustion engine, the single control valve may actuate the variable valve timing mechanism in a timing advance direction and may maintain the state, where working oil is supplied to or drained from the phase locking mechanism, in the second supply/drain state in a sixth operation mode, and, when there is a request to lock the valve timing at the intermediate timing and the valve timing at that time is retarded with respect to the intermediate timing, the variable valve timing apparatus may maintain an operation mode of the control valve in the sixth operation mode to change the valve timing to be advanced with respect to the intermediate timing and then may maintain the operation mode of the control valve in the fifth operation mode to retard the valve timing.

In the variable valve timing apparatus for an internal combustion engine, when there is a request to lock the valve timing at the intermediate timing and the valve timing at that time is advanced with respect to the intermediate timing, the variable valve timing apparatus may maintain an operation mode of the control valve in the fifth operation mode to retard the valve timing.

In the variable valve timing apparatus for an internal combustion engine, the variable valve timing mechanism may vary a relative phase that is a relative rotational phase between an input rotor that rotates in conjunction with a crankshaft and an output rotor that rotates in conjunction with a camshaft of the engine valve to thereby change the valve timing, the phase locking mechanism may include a restricting member that is provided for an accommodating rotor, which is one of the input rotor and the output rotor, and that is displaced between the lock position and the release position with respect to the accommodating rotor and a restricting hole that is provided for an engaged rotor, which is the other one of the input rotor and the output rotor, and into which the restricting member is fitted, and, when the relative phase is an intermediate phase corresponding to the intermediate timing and the state where working oil is supplied or drained by the hydraulic pressure control mechanism is the first supply/drain state, the restricting member may be displaced to the lock position to be fitted into the restricting hole to thereby lock the valve timing at the intermediate timing, and, when the relative phase is the intermediate phase corresponding to the intermediate timing and the state where working oil is supplied or drained by the hydraulic pressure control mechanism is the second supply/drain state, the restricting member may be displaced to the release position to be withdrawn from the restricting hole to thereby unlock the valve timing from the intermediate timing.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein:

FIG. 3A to FIG. 3D are schematic views for which the cross-sectional structure of the variable valve timing mechanism according to the first embodiment, taken along the line A2-A2 in FIG. 2A, is developed on a plane;

FIG. 6A to FIG. 6D are cross-sectional views that respectively show the cross-sectional structures of the oil control valve according to the first embodiment in respective operation modes;

FIG. 8A is a table that shows the relationship between the operation mode of the oil control valve according to the first embodiment and a mode in which lubricating oil is supplied to the variable valve timing mechanism;

FIG. 8B is a table that shows the relationship between the operation mode of the oil control valve and a mode in which the variable valve timing mechanism or a lock pin is operated;

FIG. 8C is a table that shows the relationship between the operation mode of the oil control valve and an engine operating state;

FIG. 11A to FIG. 11D are cross-sectional views that respectively show the cross-sectional structures of an oil control valve in respective operation modes in a variable valve timing apparatus for an internal combustion engine according to a second embodiment of the invention;

FIG. 12A to FIG. 12D are cross-sectional views that respectively show the cross-sectional structures of an oil control valve in respective operation modes in a variable valve timing apparatus for an internal combustion engine according to a third embodiment of the invention;

FIG. 14A to FIG. 14D are cross-sectional views that respectively show the cross-sectional structures of an oil control valve in respective operation modes in a variable valve timing apparatus for an internal combustion engine according to a fifth embodiment of the invention;

FIG. 15A is a table that shows the relationship between the operation mode of the oil control valve according to the fifth embodiment and a mode in which lubricating oil is supplied to the variable valve timing mechanism;

FIG. 15B is a table that shows the relationship between the operation mode of the oil control valve and a mode in which the variable valve timing mechanism or a lock pin is operated;

FIG. 15C is a table that shows the relationship between the operation mode of the oil control valve and an engine operating state.

DETAILED DESCRIPTION OF EMBODIMENTS

A first embodiment in which a variable valve timing apparatus for an internal combustion engine according to the aspect of the invention is embodied as a variable valve timing apparatus that changes the valve timing of an intake valve will be described with reference to FIG. 1 to FIG. 10D. In the present embodiment, the variable valve timing apparatus includes a variable valve timing mechanism 30, an oil control valve 51 and an electronic control unit 100.

Figure 1:
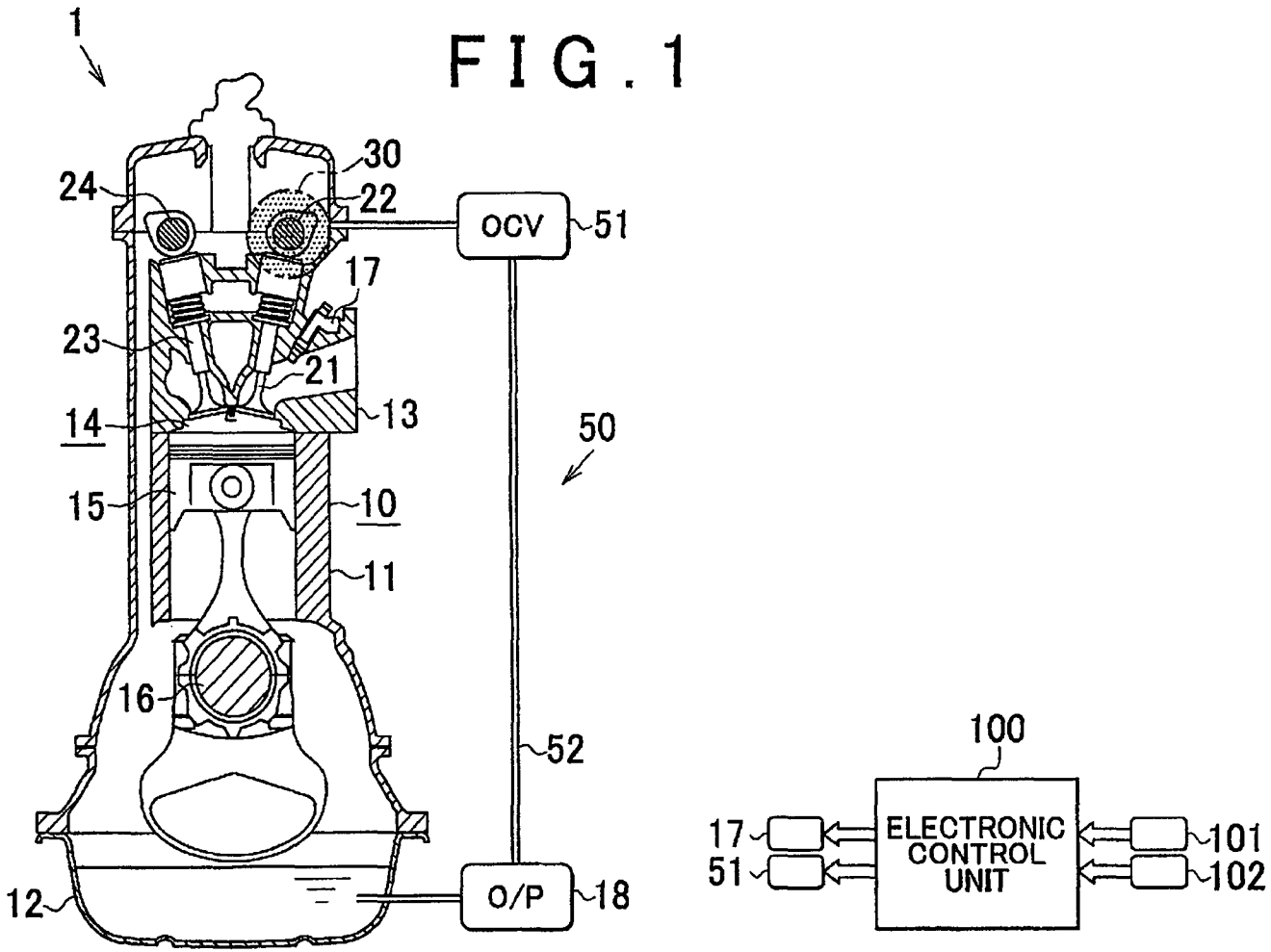
FIG. 1 is a schematic view of the configuration of an internal combustion engine to which a variable valve timing apparatus according to a first embodiment of the invention is applied.

As shown in FIG. 1, an internal combustion engine 1 includes an engine body 10, the variable valve timing mechanism 30, a hydraulic pressure supply device 50 and the electronic control unit 100. The engine body 10 gains power through combustion of a mixture of air and fuel. The variable valve timing mechanism 30 changes the valve timing of an intake valve 21. The hydraulic pressure supply device 50 supplies lubricating oil to the engine body 10 and the variable valve timing mechanism 30. The electronic control unit 100 comprehensively controls these devices.

The engine body 10 includes a cylinder block 11. In the cylinder block 11, a mixture of fuel injected through an injector 17 and air flowing through an intake passage is combusted in a combustion chamber 14, and then the linear motion of a piston 15 resulting from the combustion of air-fuel mixture is converted into the rotational motion of a crankshaft 16. An oil pan 12 is installed on the lower side of the cylinder block 11. The oil pan 12 stores lubricating oil to be supplied to various portions of the internal combustion engine 1. A cylinder head 13 is installed on the upper side of the cylinder block 11. Components of a valve train are arranged in the cylinder head 13.

The intake valve 21, an intake camshaft 22, an exhaust valve 23 and an exhaust camshaft 24 are provided in the cylinder head 13. The intake valve 21 opens or closes the combustion chamber 14 to or from the intake passage. The intake camshaft 22 drives the intake valve 21 to open or close. The exhaust valve 23 opens or closes the combustion chamber 14 to or from an exhaust passage. The exhaust camshaft 24 drives the exhaust valve 23 to open or close.

An oil pump 18 is coupled to the crankshaft 16. The oil pump 18 pumps up lubricating oil in the oil pan 12 and then discharges the pumped lubricating oil. Lubricating oil discharged by the oil pump 18 is supplied to various portions of the internal combustion engine 1 via an lubricating oil passage 52. Part of the lubricating oil is supplied to the variable valve timing mechanism 30 via the oil control valve 51. In addition, lubricating oil that has circulated through various portions of the internal combustion engine 1 and lubricating oil drained from the variable valve timing mechanism 30 are returned to the oil pan 12 again.

Various sensors, such as a crank position sensor 101 and a cam position sensor 102, are connected to the electronic control unit 100. The various sensors are used to support control executed by the electronic control unit 100. The crank position sensor 101 is provided near the crankshaft 16. The crank position sensor 101 outputs a signal corresponding to the rotational angle of the crankshaft 16. The earn position sensor 102 is provided near the intake camshaft 22. The cam position sensor 102 outputs a signal corresponding to the rotational angle of the camshaft 22. The electronic control unit 100 calculates the valve timing of the intake valve 21 (hereinafter, referred to as "valve timing INVT") on the basis of the signal output from the crank position sensor 101 and the signal output from the cam position sensor 102.

The electronic control unit 100 executes various controls, such as fuel injection control for regulating a fuel injection flow rate through control over the injector 17 and valve timing control for regulating the valve timing INVT through control over the oil control valve 51, on the basis of the signals output from these sensors.

Figure 2A:
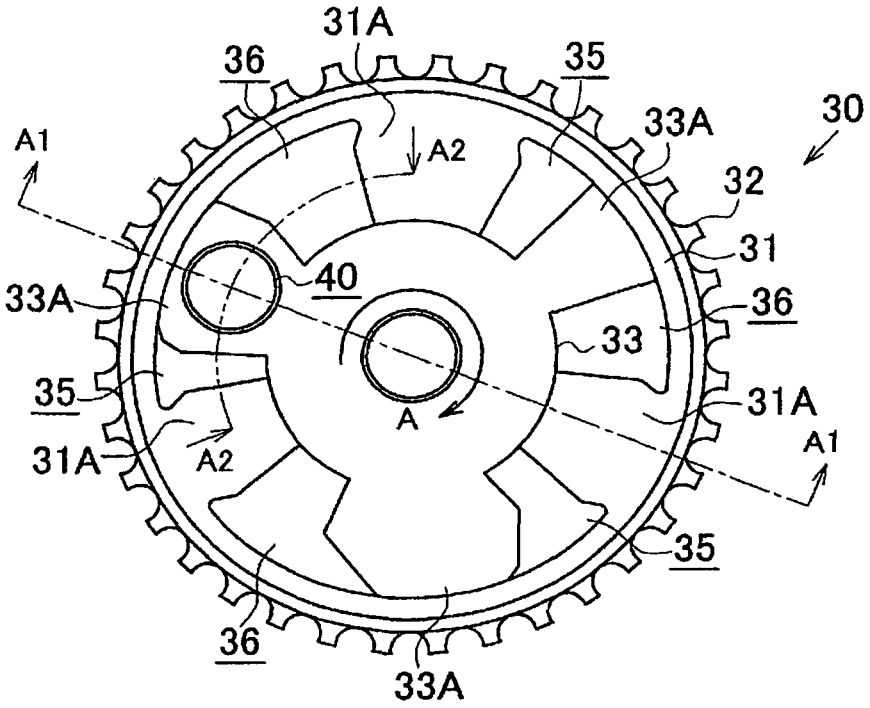
FIG. 2A is a plan view that shows the planar structure of a variable valve timing mechanism that constitutes the variable valve timing apparatus according to the first embodiment.
Figure 2B:
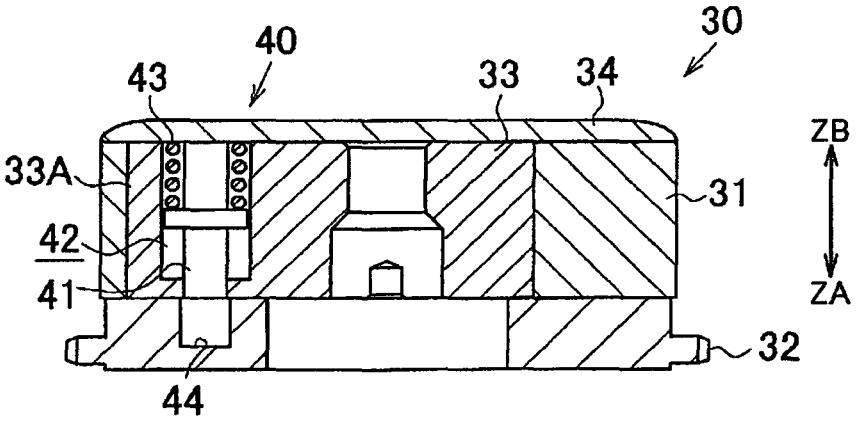
FIG. 2B is a cross-sectional view that shows the cross-sectional structure taken along the line A1-A1 in FIG. 2A.

The configuration of the variable valve timing mechanism 30 will be described with reference to FIG. 2A and FIG. 2B. Note that FIG. 2A shows the planar structure of the variable valve timing mechanism in a state where a cover 34 is removed from a housing 31. In addition, the arrow A in FIG. 2A indicates the direction in which the intake camshaft 22 and the variable valve timing mechanism 30 rotate.

The variable valve timing mechanism 30 is formed of a sprocket 32 and a vane rotor 33. The sprocket 32 is coupled to the crankshaft 16 via a timing chain to rotate in conjunction with the crankshaft 16. The vane rotor 33 is fixed to an end of the intake camshaft 22 to rotate in conjunction with the intake camshaft 22. The housing 31 is coupled to the sprocket 32. The housing 31 rotates integrally with the sprocket 32. The vane rotor 33 is arranged in a space inside the housing 31, and then the cover 34 is attached to the housing 31. Thus, the vane rotor 33 is accommodated in the space.

Three partition walls 31A are provided for the housing 31. The three partition walls 31A radially protrude toward the vane rotor 33. In addition, three vanes 33A are provided for the vane rotor 33. The three vanes 33A protrude toward the housing 31. A space between any adjacent partition walls 31A is partitioned by a corresponding one of the vanes 33A into an advance chamber 35 and a retard chamber 36.

Each advance chamber 35 is located on a following side in the rotation direction of the intake camshaft 22 with respect to the vane 33A. The volume of the advance chamber 55 varies with a state where lubricating oil is supplied to or drained from the variable valve timing mechanism 30 by the hydraulic pressure supply device 50. On the other hand, each retard chamber 36 is located on a preceding side in the rotation direction of the intake camshaft 22 with respect to the vane 33A. The volume of the retard chamber 36, as well as the advance chamber 35, varies with a state where lubricating oil is supplied to or drained from the variable valve timing mechanism 30 by the hydraulic pressure supply device 50.

The variable valve timing mechanism 30 varies the relative rotational phase of the vane rotor 33 with respect to the housing 31 and the sprocket 32 on the basis of the above configuration to thereby change the valve timing INVT. The valve timing INVT is specifically changed by the variable valve timing mechanism 30 as follows.

When lubricating oil is supplied to the advance chambers 35 and drained from the retard chambers 36 to cause the vane rotor 33 to rotate toward an advance side with respect to the housing 31, that is, the preceding side in the rotation direction of the intake camshaft 22, the valve timing INVT changes to be advanced. When the vane rotor 33 fully rotates toward the advance side with respect to the housing 31, the valve timing INVT is set at the most advanced timing (hereinafter, referred to as "most advanced timing INVTmax"). Hereinafter, the rotational phase of the vane rotor 33 with respect to the housing 31 at this time is defined as most advanced phase PH. Note that a phase at which the vanes 33A are pressed against the respective partition walls 31A as the vane rotor 33 rotates toward the advance side, or a phase at which the vane rotor 33 is placed near that phase, is set as the most advanced phase PH.

When lubricating oil is drained from the advance chambers 35 and supplied to the retard chambers 36 to cause the vane rotor 33 to rotate toward a retard side with respect to the housing 31, that is, the following side in the rotation direction of the intake camshaft 22, the valve timing INVT changes to be retarded. When the vane rotor 33 fully rotates toward the retard side with respect to the housing 31, the valve timing INVT is set at the most retarded timing (hereinafter, referred to as "most retarded timing INVTmin"). Hereinafter, the rotational phase of the vane rotor 3 with respect to the housing 31 at this time is defined as most retarded phase PL. Note that a phase at which the vanes 33A are pressed against the respective partition walls 31A as the vane rotor 33 rotates toward the retard side, or a phase at which the vane rotor 33 is placed near that phase, is set as the most retarded phase PL.

Circulation of lubricating oil between the hydraulic pressure supply device 50 and both the advance chambers 35 and the retard chambers 36 is shut off, that is, lubricating oil is held in the advance chambers 35 and the retard chambers 36. By so doing, relative rotation between the housing 31 and the vane rotor 33 is disabled, and the valve timing INVT is maintained at the timing then.

The variable valve timing mechanism 30 includes an intermediate locking mechanism 40. The intermediate locking mechanism 40 restricts rotation of the vane rotor 33 with respect to the housing 31 to lock the valve timing INVT at a specific timing between the most advanced timing INVTmax and the most retarded timing INVTmin (hereinafter, referred to as "intermediate timing INVTmdl") irrespective of the hydraulic pressure in each advance chamber 35 or the hydraulic pressure in each retard chamber 36. The timing suitable, for engine start is set as the intermediate timing INVTmdl. That is, when, at the time of engine start, the case where the valve timing INVT is set at the intermediate timing INVTmdl is compared with the case where the valve timing INVT is set at the timing that is retarded with respect to the intermediate timing INVT, the former case ensures higher startability than the latter case.

The intermediate locking mechanism 40 operates on the basis of a state where lubricating oil is supplied to or drained from the intermediate locking mechanism 40 by the hydraulic pressure supply device 50. When the rotational phase of the vane rotor 33 with respect to the housing 31 is the rotational phase corresponding to the intermediate timing INVTmdl (hereinafter, referred to as "intermediate phase PM"), the intermediate locking mechanism 40 locks the housing 31 and the vane rotor 33 with respect to each other to hold the valve timing INVT at the intermediate timing INVTmdl.

Specifically, the intermediate locking mechanism 40 is formed of a lock pin 41, an intermediate chamber 42, a lock spring 43 and a lock hole 44. The lock pin 41 is provided for one of the vanes 33A. The intermediate chamber 42 is similarly formed in that vane 33A, and is supplied with lubricating oil by the hydraulic pressure supply device 50. In addition, the lock spring 43 is similarly provided for that vane 33A, and presses the lock pin 41 in one direction. The lock hole 44 is provided for the housing 31.

The lock pin 41 is displaced between a direction to project from the vane 33A (hereinafter, referred to as "projecting direction ZA") and a direction to withdraw into the vane 33A (hereinafter, referred to as "accommodating direction ZB") on the basis of the relationship between the force of lubricating oil in the intermediate chamber 42 and the force of the lock spring 43. The hydraulic pressure in the intermediate chamber 42 acts on the lock pin 41 in the accommodating direction ZB. The force of the lock spring 43 acts on the lock pin 41 in the projecting direction ZA.

When lubricating oil is supplied to the intermediate chamber 42 by the hydraulic pressure supply device 50 to fill the intermediate chamber 42 with lubricating oil, that is, when a state where lubricating oil is supplied to or drained from the intermediate chamber 42 is a "first supply/drain state", the force in the accommodating direction ZB resulting from the lubricating oil in the intermediate chamber 42 exceeds the force in the accommodating direction ZA resulting from the lock spring 43. Thus, force that tries to displace the lock pin 41 in the accommodating direction ZB occurs on the lock pin 41. Then, when the force in the accommodating direction ZB acts on the lock pin 41 in a situation that the lock pin 41 is fitted in the lock hole 44, the lock pin 41 comes off from the lock hole 44 and is displaced to a release position, and is then accommodated in the vane 33A. By so doing, locking of the housing and the vane rotor 33 through engagement of the lock pin 41 with the lock hole 44 is released to thereby allow the vane rotor 33 to rotate with respect to the housing 31.

On the other hand, when lubricating oil is drained by the hydraulic pressure supply device 50 from the intermediate chamber 42 and, therefore, the intermediate chamber 42 is not filled with lubricating oil, that is, when the state where lubricating oil is supplied to or drained from the intermediate chamber 42 is a "second supply/drain state", force that tries to displace the lock pin 41 in the projecting direction ZA occurs owing to the force in the projecting direction ZA resulting from the lock spring 43. Then, in this state, when the rotational phase of the vane rotor 33 with respect to the housing 31 is the intermediate phase PM, that is, when the positions of the lock pin 41 and lock hole 44 in the circumferential direction coincide with each other, the lock pin 41 projects from the vane 33A to a lock position and is then fitted into the lock hole 44. By so doing, the housing 31 and the vane rotor 33 are locked with respect to each other through engagement of the lock pin 41 with the lock hole 44 to thereby hold the relative rotational phase of them at the intermediate phase PM.

FIG. 3A to FIG. 3D schematically show the cross-sectional structure of the variable valve timing mechanism 30. Note that FIG. 3A to FIG. 3D are schematic views for which the cross-sectional structure of the variable valve timing mechanism 30, taken along the line A2-A2 in FIG. 2A, is developed on a plane.

When the rotational phase of the vane rotor 33 with respect to the housing 31 is varied from the most advanced phase PH shown in FIG. 3A to the most retarded phase PL shown in FIG. 3B, the lock pin 41 is maintained in a state where the lock pin 41 is accommodated in the vane 33A. In addition, even when the rotational phase of the vane rotor 33 is the intermediate phase PM, as long as the lock pin 41 is accommodated in the vane 33A owing to the lubricating oil supplied to the intermediate chamber 42, the rotational phase of the vane rotor 33 is not locked at the intermediate phase PM as shown in FIG. 3C.

On the other hand, when lubricating oil is drained from the intermediate chamber 42 to exert the force in the projecting direction ZA on the lock pin 41 while the rotational phase of the vane rotor 33 is the intermediate phase PM, the lock pin 41 projects from the vane 33A and is fitted into the lock hole 44 as shown in FIG. 3D. Thus, the vane rotor 33 is held at the intermediate phase PM.

With the above configuration, under a situation that the force in the projecting direction ZA acts on the lock pin 41 and the lock pin 41 is located on the retard side with respect to the lock hole 44, when the vane rotor 33 is actuated toward the advance side with respect to the housing 31, the distal end of the lock pin 41 is fitted into the lock hole 44 when the relative rotational phase of them reaches the intermediate phase PM.

Figure 4:
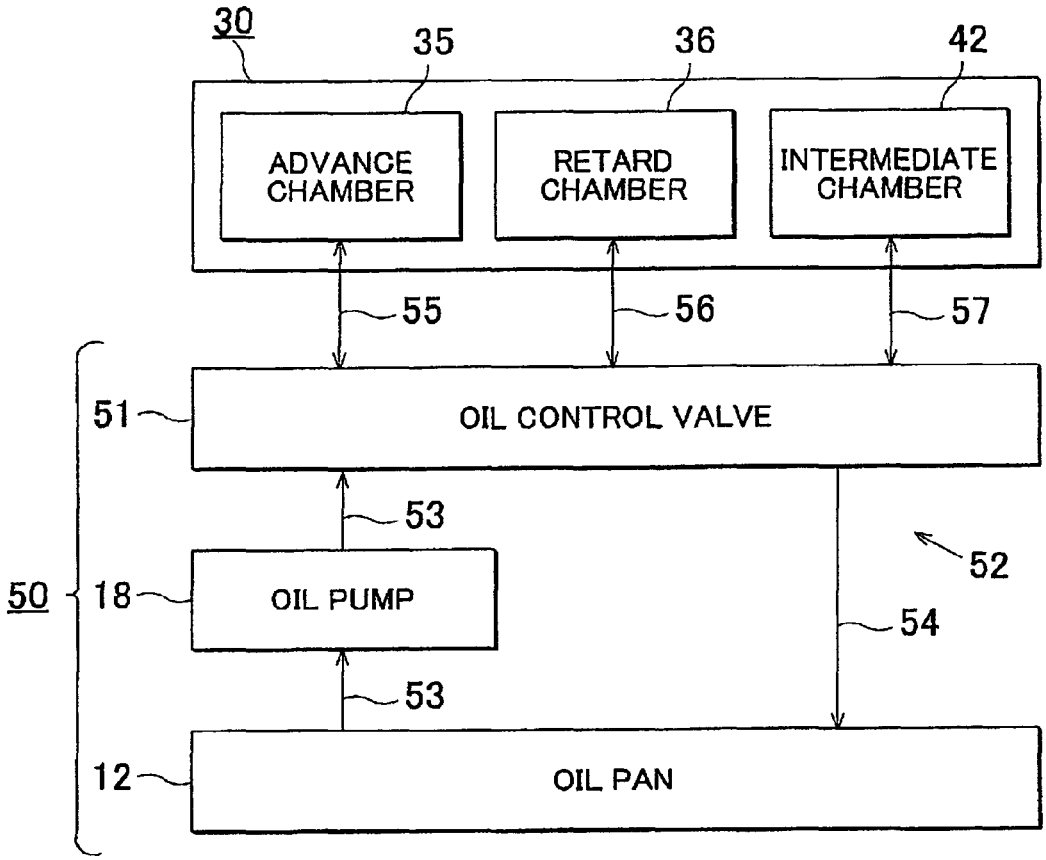
FIG. 4 is a schematic view that shows the configuration of a lubricating oil passage in the variable valve timing mechanism according to the first embodiment.

A mode in which lubricating oil is circulated between the variable valve timing mechanism 30 and the hydraulic pressure supply device 50 will be described with reference to FIG. 4. Note that FIG. 4 schematically shows the configuration of an oil passage between these devices.

The hydraulic pressure supply device 50 is formed of an oil pan 12, an oil pump 18, an oil control valve 51 and a lubricating oil passage 52. The lubricating oil passage 52 circulates lubricating oil among the oil pan 12, the oil pump 18 and the oil control valve 51. In addition, the lubricating oil passage 52 includes an oil supply passage 53, an oil drain passage 54, an advance oil passage 55, a retard oil passage 56 and an intermediate oil passage 57. The oil supply passage 53 supplies lubricating oil from the oil pan 12 to the oil control valve 51. The oil drain passage 54 returns lubricating oil from the oil control valve 51 to the oil pan 12. The advance oil passage 55 circulates lubricating oil between the oil control valve 51 and each advance chamber 35. The retard oil passage 56 circulates lubricating oil between the oil control valve 51 and each retard chamber 36. The intermediate oil passage 57 circulates lubricating oil between the oil control valve 51 and the intermediate chamber 42.

The advance oil passage 55 directly connects the oil control valve 51 with the advance chambers 35. The retard oil passage 56 directly connects the oil control valve 51 with the retard chambers 36. The intermediate oil passage 57 directly connects the oil control valve 51 with the intermediate chamber 42. That is, the intermediate oil passage 57 is formed as an oil passage that circulates lubricating oil between the oil control valve 51 and the intermediate chamber 42 without passing through the advance chambers 35 or the retard chambers 36.

The oil control valve 51 changes a fluid communication state between the oil supply and drain passages 53 and 54 and the advance, retard and intermediate oil passages 55, 56 and 57 to thereby change a state where lubricating oil is supplied to or drained from each of the advance chambers 35, the retard chambers 36 and the intermediate chamber 42.

The structure of the oil control valve 51 and the operation mode thereof will be described with reference to FIG. 5 to FIG. 6D. Note that FIG. 5 to FIG. 6D each shows the cross-sectional structure taken in the axial direction of the oil control valve 51 and respectively show the cross-sectional structures in different operation modes. In addition, the arrows in the drawings indicate flow of lubricating oil.

Figure 5:
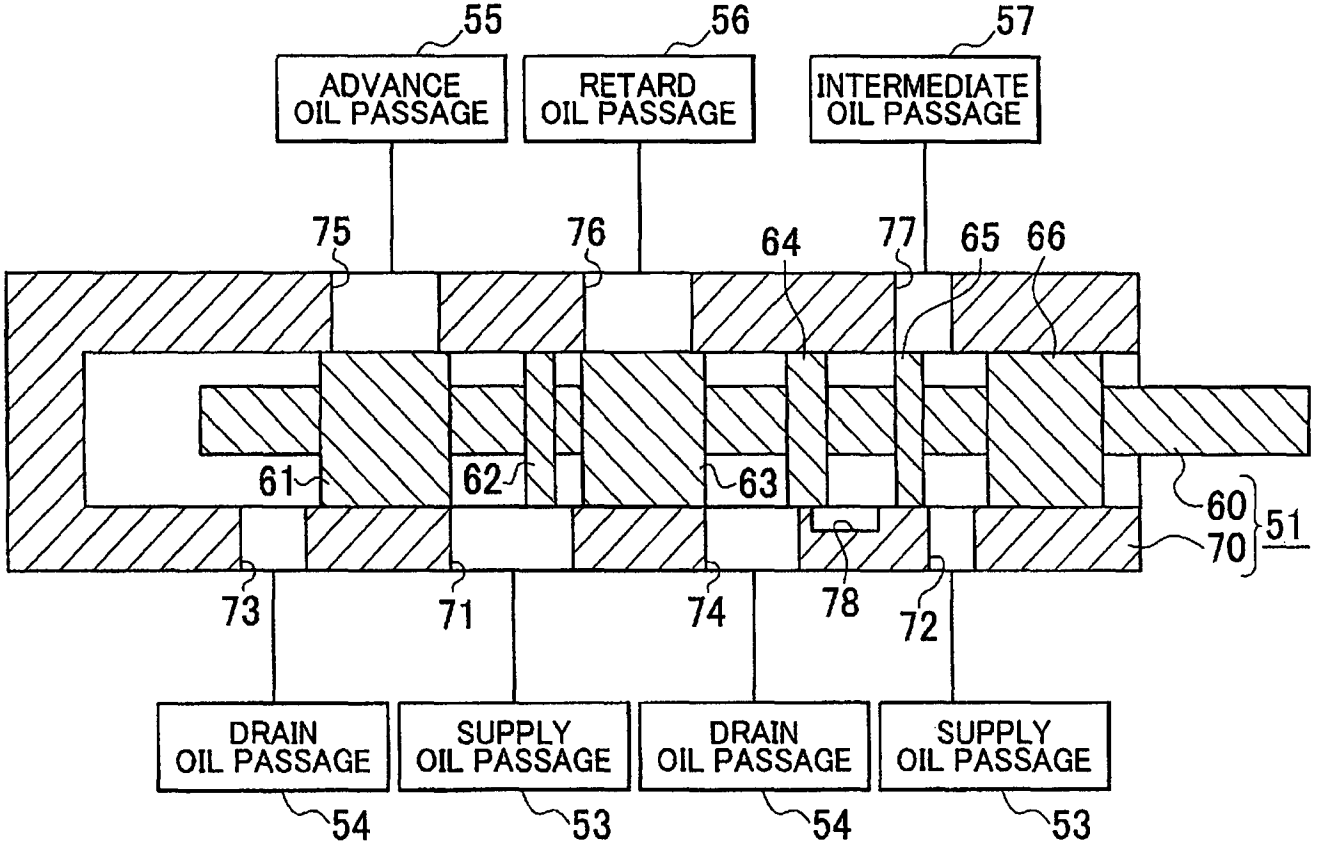
FIG. 5 is a cross-sectional view that shows the cross-sectional structure of an oil control valve that constitutes a hydraulic pressure supply device according to the first embodiment.

As shown in FIG. 5, the oil control valve 51 includes a single sleeve 70 and a single spool 60. The sleeve 70 has a plurality of ports. The spool 60 is provided in the sleeve 70. Then, the spool 60 is displaced with respect to the sleeve 70 to change the fluid communication state among the ports to change the state where lubricating oil is supplied to or drained from each of the advance chambers 35, the retard chambers 36 and the intermediate chamber 42.

The sleeve 70 has an advance port 75, a retard port 76 and an intermediate port 77. The advance port 75 is connected to the advance oil passage 55. The retard port 76 is connected to the retard oil passage 56. The intermediate port 77 is connected to the intermediate oil passage 57. In addition, the advance port 75, the retard port 76 and the intermediate port 77 are arranged in the stated order in the axial direction of the sleeve 70.

The sleeve 70 has a first supply port 71, a second supply port 72, a first drain port 73 and a second drain port 74 in addition to the above ports. The first supply port 71 is connected to the oil supply passage 53. The second supply port 72 is separately formed from the first supply port 71 and is similarly connected to the oil supply passage 53. The first drain port 73 is connected to the oil drain passage 54. The second drain port 74 is separately formed from the first drain port 73 and is similarly connected to the oil drain passage 54. Furthermore, an intermediate communication passage 78 is formed on an inner wall of the sleeve 70 between the second supply port 72 and the second drain port 74. The intermediate communication passage 78 is formed as a groove having a shape along the wall surface.

The spool 60 has the following valve elements that vary the opening areas of the respective ports 71 to 77 as the spool 60 is displaced with respect to the sleeve 70. That is, the spool 60 has an advance valve 61, a regulating valve 62, a retard valve 63, a first intermediate valve 64, a second intermediate valve 65 and a third intermediate valve 66. The advance valve 61 varies the respective opening areas of the first supply port 71, first drain port 73 and advance port 75. The regulating valve 62 varies the respective opening areas of the first supply port 71 and retard port 76. The retard valve 63 varies the respective opening areas of the first supply port 71, second drain port 74 and retard port 76. The first intermediate valve 64 varies the respective opening areas of the second drain port 74 and intermediate port 77. The second intermediate valve 65 varies the respective opening areas of the second supply port 72 and intermediate port 77. The third intermediate valve 66 varies the respective opening areas of the second supply port 72 and intermediate port 77.

In the thus structured oil control valve 51, a fluid communication state among the ports is changed as the spool 60 is displaced with respect to the sleeve 70 to thereby set the operation mode to any one of the following first to fourth modes.

The operation modes of the oil control valve 51 will be described with reference to FIG. 6A to FIG. 6D. As shown in FIG. 6A, when the position of the spool 60 with respect to the sleeve 70 is a first position, the operation mode is set to the first mode, and the following fluid communication state is maintained among the ports. That is, a fluid communication between the advance port 75 and the first drain port 73 is established, and a fluid communication between the advance port 75 and the first supply port 71 is shut off by the advance valve 61. In addition, a fluid communication between the retard port 76 and the first supply port 71 is established, and a fluid communication between the retard port 76 and the second drain port 74 is shut off by the retard valve 63. In addition, a fluid communication between the intermediate port 77 and the second supply port 72 is established, and a fluid communication between the intermediate port 77 and the second drain port 74 is shut off by the first intermediate valve 64.

The above fluid communication state is established among the ports in the first mode, so lubricating oil in the advance chambers 35 flows through the advance oil passage 55, the advance port 75, the first drain port 73 and the oil drain passage 54 in the stated order and then returns to the oil pan 12. In addition, lubricating oil from the oil pump 18 flows through the oil supply passage 53, the first supply port 71, the retard port 76 and the retard oil passage 56 in the stated order and is then supplied to the retard chambers 36. In addition, lubricating oil from the oil pump 18 flows through the oil supply passage 53, the second supply port 72, the intermediate port 77 and the intermediate oil passage 57 in the stated order and is then supplied to the intermediate chamber 42.

As shown in FIG. 6B, when the position of the spool 60 with respect to the sleeve 70 is a second position, the operation mode is set to the second mode, and the following fluid communication state is maintained among the ports. That is, a fluid communication between the advance port 75 and the first supply port 71 is shut off by the advance valve 61, and a fluid communication between the advance port 75 and the first drain port 73 is shut off by the advance valve 61. In addition, a fluid communication between the retard port 76 and the first supply port 71 is shut off by the retard valve 63, and a fluid communication between the retard port 76 and the second drain port 74 is shut off by the retard valve 63. In addition, a fluid communication between the intermediate port 77 and the second supply port 72 is established, and a fluid communication between the intermediate port 77 and the second drain port 74 is shut off by the second intermediate valve 65.

The above fluid communication state is established among the ports in the second mode, so both flow of lubricating oil from the oil pump 18 to the advance chambers 35 via the oil control valve 51 and flow of lubricating oil from the advance chambers 35 to the oil pan 12 via the oil control valve 51 are shut off. In addition, both flow of lubricating oil from the oil pump 18 to the retard chambers 36 via the oil control valve 51 and flow of lubricating oil from the retard chambers 36 to the oil pan 12 via the oil control valve 51 are shut off. Then, lubricating oil from the oil pump 18 flows through the oil supply passage 53, the second supply port 72, the intermediate port 77 and the intermediate oil passage 57 in the stated order and is then supplied to the intermediate chamber 42.

As shown in FIG. 6C, when the position of the spool 60 with respect to the sleeve 70 is a third position, the operation mode is set to the third mode, and the following fluid communication state is maintained among the ports. That is, a fluid communication between the advance port 75 and the first supply port 71 is established, and a fluid communication between the advance port 75 and the first drain port 73 is shut off by the advance valve 61. In addition, a fluid communication between the retard port 76 and the second drain port 74 is established, and a fluid communication between the retard port 76 and the first supply port 71 is shut off by the retard valve 63. In addition, a fluid communication between the intermediate port 77 and the second supply port 72 is established, and a fluid communication between the intermediate port 77 and the second drain port 74 is shut off by the second intermediate valve 65.

The above fluid communication state is established among the ports in the third mode, so lubricating oil from the oil pump 18 flows through the oil supply passage 53, the first supply port 71, the advance port 75 and the advance oil passage 55 in the stated order and is then supplied to the advance chambers 35. In addition, lubricating oil in the retard chambers 36 flows through the retard oil passage 56, the retard port 76, the second drain port 74 and the oil drain passage 54 in the stated order and then returns to the oil pan 12. In addition, lubricating oil from the oil pump 18 flows through the oil supply passage 53, the second supply port 72, the intermediate port 77 and the intermediate oil passage 57 in the stated order and is then supplied to the intermediate chamber 42.

As shown in FIG. 6D, when the position of the spool 60 with respect to the sleeve 70 is a fourth position, the operation mode is set to the fourth mode, and the following fluid communication state is maintained among the ports. That is, a fluid communication between the advance port 75 and the first supply port 71 is established, and a fluid communication between the advance port 75 and the first drain port 73 is shut off by the advance valve 61. In addition, a fluid communication between the retard port 76 and the second drain port 74 is established, and a fluid communication between the retard port 76 and the first supply port 71 is shut off by the retard valve 63. In addition, a fluid communication between the intermediate port 77 and the second drain port 74 is established via the intermediate communication passage 78, and a fluid communication between the intermediate port 77 and the second supply port 72 is shut off by the third intermediate valve 66.

The above fluid communication state is established among the ports in the fourth mode, so lubricating oil from the oil pump 18 flows through the oil supply passage 53, the first supply port 71, the advance port 75 and the advance oil passage 55 in the stated order and is then supplied to the advance chambers 35 in a state where the flow rate is throttled as compared with that in the third mode. In addition, lubricating oil in the retard chambers 36 flows through the retard oil passage 56, the retard port 76, the second drain port 74 and the oil drain passage 54 in the stated order and then returns to the oil pan 12. In addition, lubricating oil in the intermediate chamber 42 flows through the intermediate oil passage 57, the intermediate port 77, the intermediate communication passage 78, the second drain port 74 and the oil drain passage 54 in the stated order and then returns to the oil pan 12.

As described above, the oil control valve 51 includes the sleeve 70 having the plurality of ports and the spool 60 having the plurality of valve elements, and the respective opening areas of the plurality of ports are varied by the corresponding valve elements among the plurality of valve elements as these sleeve 70 and spool 60 are relatively displaced.

In the third mode or the fourth mode, among the plurality of ports, the advance port 75 connected to the advance chambers 35 of the variable valve timing mechanism 30 and the first supply port 71 connected to the lubricating oil supply source are in fluid communication with each other. Thus, an advance chamber flow passage 58 that supplies lubricating oil to the advance chambers 35 of the variable valve timing mechanism 30 is formed in the oil control valve 51.

The opening area of the first supply port 71 in the fourth mode is smaller than the opening area of the first supply port 71 in the third mode, so the flow rate of lubricating oil in the advance chamber flow passage 58 in the fourth mode is lower than the flow rate of lubricating oil in the advance chamber flow passage 58 in the third mode. Thus, the amount of lubricating oil supplied to the advance chambers 35 in the fourth mode is smaller than the amount of lubricating oil supplied to the advance chambers 35 in the third mode, so the rate of change at which the variable valve timing mechanism 30 is advanced in the fourth mode is lower than the rate of change at which the variable valve timing mechanism 30 is advanced in the third mode.

That is, when the operation mode is the third mode, the variable valve timing mechanism 30 rotates in the timing advance direction, and the state where lubricating oil is supplied to or drained from the intermediate locking mechanism 40 is maintained in a supply state. When the operation mode is the fourth mode, under a situation that the amount of lubricating oil supplied to the variable valve timing mechanism 30 is smaller than that in the third mode, the variable valve timing mechanism 30 rotates in the timing advance direction and then the state where lubricating oil is supplied to or drained from the intermediate locking mechanism 40 is maintained in a drain state.

Figures 7A, 7B, 7C:
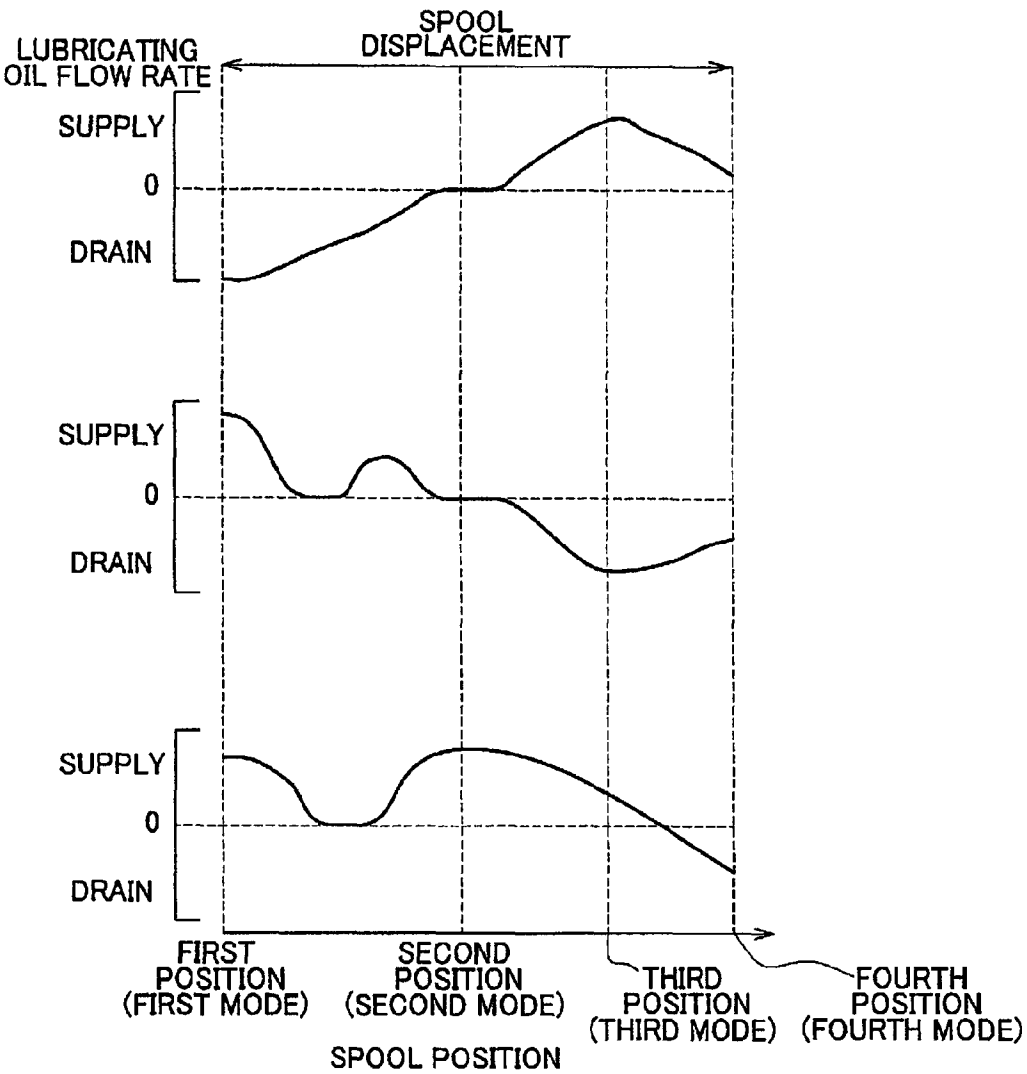
FIG. 7A to FIG. 7C are graphs that show the relationships of lubricating oil flow rates of respective ports with respect to a spool position in the oil control valve according to the first embodiment.

The relationships between the position of the spool 60 with respect to the sleeve 70 and respective lubricating oil flow rates to the advance chambers 35, the retard chambers 36 and the intermediate chamber 42 will be described with reference to FIG. 7A to FIG. 7C.

(A) When the spool 60 is located at the first position, the flow rate in the drain direction at the advance port 75 is maximal. As the spool 60 is displaced from the first position toward the second position, the flow rate in the drain direction at the advance port 75 gradually decreases. When the spool 60 is located at or near the second position, both the flow rates in the supply direction and drain direction at the advance port 75 are "0". As the spool 60 is displaced from the second position toward the third position, the flow rate in the supply direction at the advance port 75 gradually increases. When the spool 60 is located near the third position, the flow rate in the supply direction at the advance port 75 is maximal. As the spool 60 is displaced from the above position toward the fourth position, the flow rate in the supply direction at the advance port 75 gradually decreases.

(B) When the spool 60 is located at the first position, the flow rate in the supply direction at the retard port 76 is maximal. In the process in which the spool 60 is displaced from the first position toward the second position, the flow rate in the supply direction at the retard port 76 gradually decreases, and then both the flow rates in the supply direction and drain direction once become "0" at a position between the first position and the second position. Then, as the spool 60 is displaced from the above position toward the second position, the flow rate in the supply direction at the retard port 76 increases again. After that, as the spool 60 is further displaced toward the second position, the flow rate in the supply direction at the retard port 76 decreases. When the spool 60 is located at or near the second position, both the flow rates in the supply direction and drain direction at the retard port 76 are "0". As the spool 60 is displaced from the second position toward the third position, the flow rate in the drain direction at the retard port 76 gradually increases. When the spool 60 is located at or near the third position, the flow rate in the drain direction at the retard port 76 is maximal. As the spool 60 is displaced from the above position toward the fourth position, the flow rate in the drain direction at the retard port 76 gradually decreases.

(C) When the spool 60 is located at the first position, the flow rate in the supply direction at the intermediate port 77 is maximal. In the process in which the spool 60 is displaced from the first position toward the second position, the flow rate in the supply direction at the intermediate port 77 gradually decreases, and then both the flow rates in the supply direction and drain direction once become "0" at a position between the first position and the second position. Then, as the spool 60 is displaced from the above position toward the second position, the flow rate in the supply direction at the intermediate port 77 increases again. When the spool 60 is located at or near the second position, the flow rate in the supply direction at the intermediate port 77 is substantially equal to the flow rate at the time when the spool 60 is located at the first position. As the spool 60 is displaced from the second position toward the third position, the flow rate in the supply direction at the intermediate port 77 gradually decreases. When the spool 60 is located between the third position and the fourth position, both the flow rates in the supply direction and drain direction at the intermediate port 77 are "0". As the spool 60 is displaced from the above position toward the fourth position, the flow rate in the drain direction at the intermediate port 77 gradually increases. When the spool 60 is located at the fourth position, the flow rate in the drain direction at the intermediate port 77 is maximal.

The relationship between the operation mode of the oil control valve 51 and the variable valve timing mechanism 30 or the intermediate locking mechanism 40 and a mode in which the operation mode is set on the basis of an engine operating state will be described with reference to FIG. 8A to FIG. 8C. Note that, in the notation of FIG. 8B, "VVT" denotes the variable valve timing mechanism 30, "projection" indicates a state where force in the projecting direction ZA acts on the lock pin 41 by the hydraulic pressure in the intermediate chamber 42 and "accommodation" indicates a state where force in the accommodating direction ZB acts on the lock pin 41 by the force of the lock spring 43.

In the first mode, lubricating oil is drained from the advance chambers 35, lubricating oil is supplied to the retard chambers 36 and lubricating oil is supplied to the intermediate chamber 42. Thus, the variable valve timing mechanism 30 is actuated in the timing retard direction, and force in the accommodating direction ZB is exerted on the lock pin 41.

In the second mode, lubricating oil in the advance chambers 35 is held, lubricating oil in the retard chambers 36 is held and lubricating oil is supplied to the intermediate chamber 42. Thus, the operation state of the variable valve timing mechanism 30 is held, and force in the accommodating direction ZB is exerted on the lock pin 41.

In the third mode, lubricating oil is supplied to the advance chambers 35, lubricating oil is drained from the retard chambers 36 and lubricating oil is supplied to the intermediate chamber 42. Thus, the variable valve timing mechanism 30 is actuated in the timing advance direction, and force in the accommodating direction ZB is exerted on the lock pin 41.

In the fourth mode, lubricating oil is supplied to the advance chambers 35 at a flow rate lower than that in the third mode, lubricating oil is drained from the retard chambers 36 and lubricating oil is drained from the intermediate chamber 42. Thus, the variable valve timing mechanism 30 is actuated in the timing advance direction at a rate of change lower than that in the third mode, and force in the projecting direction ZA is exerted on the lock pin 41.

As shown in FIG. 8C, the operation mode of the oil control valve 51 is changed as follows on the basis of an engine operating state. Note that, in the following description, a request to lock the valve timing INVT at the intermediate timing INVTmdl is termed "lock request".

When the engine is started, that is, when there is a lock request, the operation mode is set to the fourth mode. In addition, when the lock request is cancelled, the operation mode is changed from the fourth mode to the second mode. In addition, when there is no lock request during operation of the engine, the operation mode is changed among the first mode, the second mode and the third mode in response to a request to change the valve timing INVT based on an engine operating state. In addition, when the engine is stopped or the engine is at idle, that is, when there is a lock request, the operation mode is changed from any one of the first mode, the second mode and the third mode to the fourth mode.

Note that, in the operation modes of the oil control valve 51 according to the present embodiment, the third mode may be regarded as, a first operation mode according to the aspect of the invention, the fourth mode may be regarded as a second operation mode according to the aspect of the invention and the first mode may be regarded as a third operation mode according to the aspect of the invention.

Figure 9:
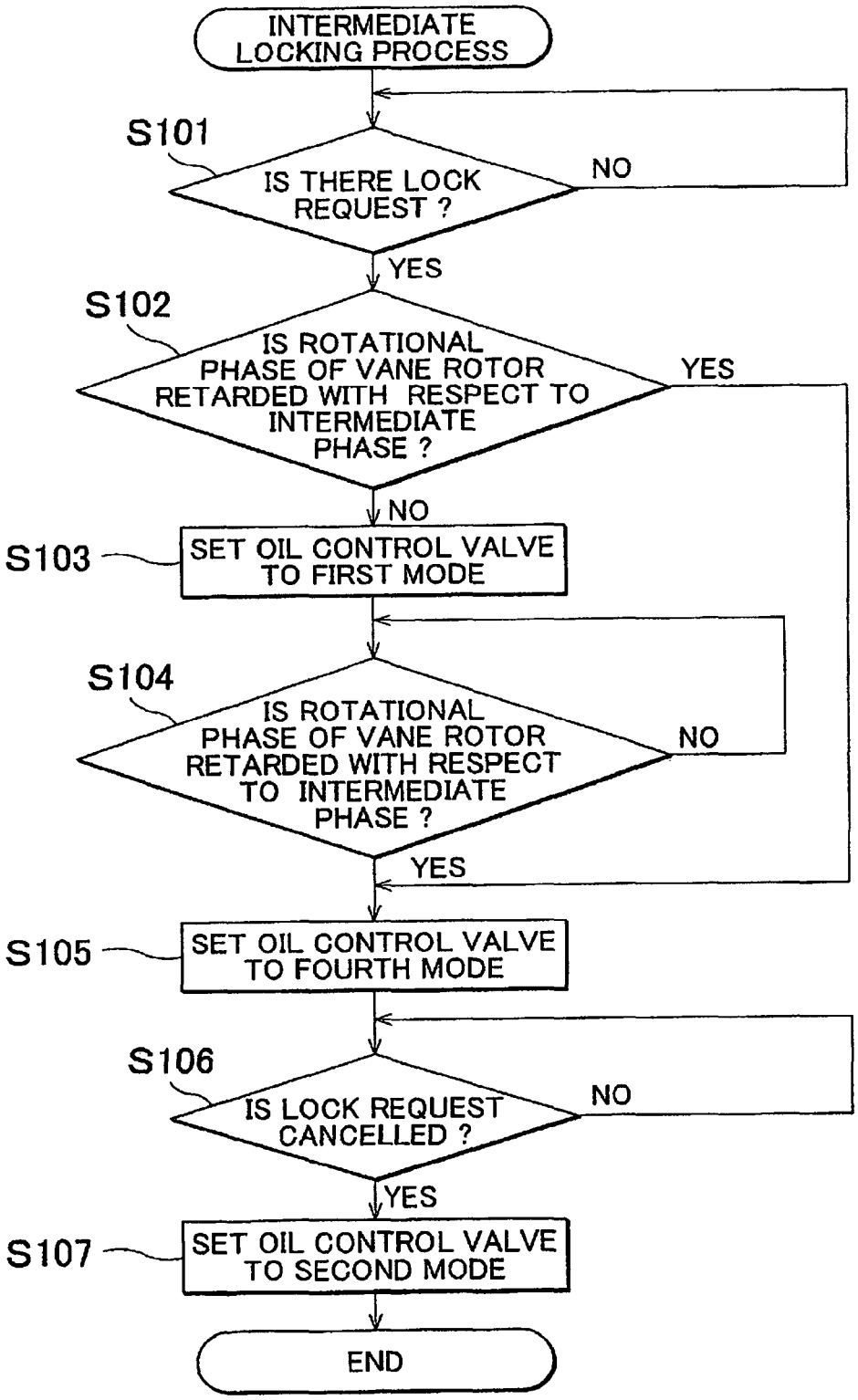
FIG. 9 is a flowchart that shows the procedure of "intermediate locking process" executed by an electronic control unit according to the first embodiment.

The procedure of "intermediate locking process" in which the valve timing INVT is locked at the intermediate timing INVTmdl by the intermediate locking mechanism 40 will be described in detail with reference to FIG. 9. In addition, an example of operation modes of the vane rotor 33 and intermediate locking mechanism 40 based on the intermediate locking process will be described with reference to FIG. 10A to FIG. 10D. Note that the intermediate locking process is executed by the electronic control unit 100 during operation of the engine. In the intermediate locking process, once the process reaches the end, a similar process is sequentially repeated from step S101 as long as the engine is in operation.

In this process, first, in step S101, it is determined whether a lock request is set. Here, the lock request is set or cancelled in the following mode in control that is separately executed by the electronic control unit 100. That is, when it is determined that there is an engine start request, an engine stop request or an idle operation request, a lock request is set on the basis of the determination. In addition, when it is determined that a request to change the valve timing INVT, the lock request is cancelled on the basis of the determination.

When it is determined that no lock request is set through the determination process of step S101, the determination process is executed again after a predetermined control interval has elapsed. On the other hand, when it is determined that a lock request is set, it is determined in the next step S102 whether the rotational phase of the vane rotor 33 with respect to the housing 31 is retarded with respect to the intermediate phase PM. That is, it is determined whether the valve timing INVT obtained from the signal output from the crank position sensor 101 and the signal output from the cam position sensor 102 is retarded with respect to the intermediate timing INVTmdl.

Figure 10A:
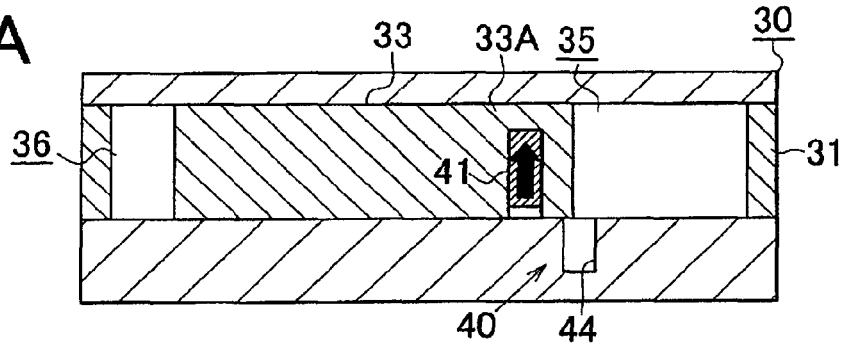
FIG. 10A to FIG. 10D are schematic views for which the cross-sectional structure of the variable valve timing mechanism according to the first embodiment, taken along the line A2-A2 in FIG. 2A, is developed on a plane.
Figure 10B:
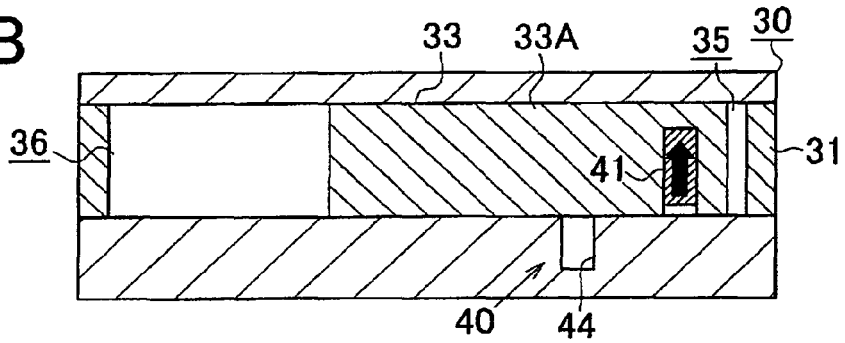

When it is determined that the rotational phase of the vane rotor 33 with respect to the housing 31 is retarded with respect to the intermediate phase PM through the determination process of step S102, that is, for example, the above rotational phase is the rotational phase shown in FIG. 10B, the process of step S103 is skipped, and the process proceeds to the process of step S105. On the other band, when it is determined that the rotational phase of the vane rotor 33 with respect to the housing 31 is advanced with respect to the intermediate phase PM, that is, for example, the above rotational phase is the rotational phase shown in FIG. 10A, the process proceeds to the process of step S103 and then proceeds to the process of step S105.

In step S103, the operation mode of the oil control valve 51 is changed to the first mode to actuate the vane rotor 33 toward the retard side. By so doing, when the vane rotor 33 is placed at the rotational phase illustrated in FIG. 10A before the process of step S105 is executed, the rotational phase of the vane rotor 33 is varied to the rotational phase that is retarded with respect to the intermediate phase PM as illustrated in FIG. 10B as the process of step S103 is executed.

When it is determined in step S104 that the rotational phase of the vane rotor 33 is retarded with respect to the intermediate phase PM, that is, when it is determined that the valve timing INVT is retarded with respect to the intermediate timing INVTmdl, the operation mode of the oil control valve 51 is changed to the fourth mode in the next step S105.

Figure 10C:
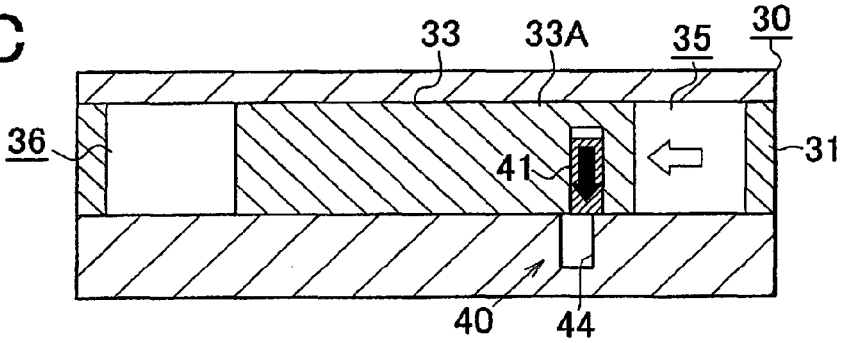
Figure 10D:
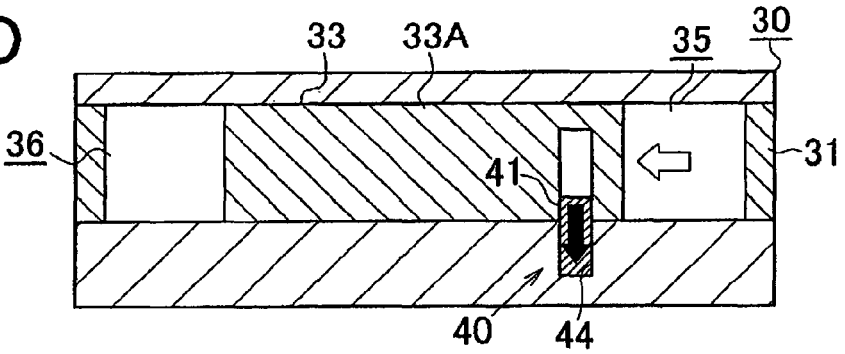

By so doing, lubricating oil is supplied to the advance chambers 35, and lubricating oil is drained from the retard chambers 36, and then the vane rotor 33 is actuated with respect to the housing 31 toward the advance side at a rate of change lower than that in the third mode as shown in FIG. 10C. In addition, at this time, lubricating oil is drained from the intermediate chamber 42, so force in the projecting direction ZA is exerted on the lock pin 41. Therefore, when the lock pin 41 is displaced to a position corresponding to the lock hole 44 as the vane rotor 33 is actuated toward the advance side, the lock pin 41 is inserted into the lock hole 44 as shown in FIG. 10D. Thus, the rotational phase of the vane rotor 33 with respect to the housing 31 is locked at the intermediate phase PM.

In the next step S106, it is determined whether the lock request is cancelled. When it is determined that the lock request is set, the same determination process is executed again after a predetermined computation interval has elapsed. By so doing, after the lock pin 41 is fitted in the lock hole 44, the fourth mode of the oil control valve 51 is maintained as long as the lock request is continuously set. Therefore, force that actuates the vane rotor 33 toward the advance side is continuously exerted by lubricating oil in the advance chambers 35. That is, the lock pin 41 is maintained in a state where the side surface of the lock pin 41 is pressed against a wall surface that defines the lock hole 44.

On the other hand, when it is determined that the lock request is cancelled, the operation mode of the oil control valve 51 is changed to the second mode in the next step S107 to thereby withdraw the lock pin 41 from the lock hole 44. After that, the third mode is selected when there is a request to advance the valve timing INVT, the first mode is selected when there is a request to retard the valve timing INVT, and the second mode is selected when there is a request to hold the valve timing INVT.

With the variable valve timing apparatus for an internal combustion engine according to the present embodiment, the following advantageous effects may be obtained.

(1) In the present embodiment, the state where lubricating oil is supplied to or drained from each of the variable valve timing mechanism 30 and the intermediate locking mechanism 40 is controlled by the single oil control valve 51. Then, in the third mode, the oil control valve 51 actuates the variable valve timing mechanism 30 in the timing advance direction and maintains the state, where lubricating oil is supplied to or drained from the intermediate locking mechanism 40, in the supply state. In the fourth mode, the oil control valve 51 actuates the variable valve timing mechanism 30 in the timing advance direction under a situation that the amount of lubricating oil supplied to the variable valve timing mechanism 30 is smaller than that in the third mode and maintains the state, where lubricating oil is supplied to or drained from the intermediate locking mechanism 40, in the drain state.

With the above configuration, the above third mode and fourth mode are prepared as the operation mode of the oil control valve 51. Therefore, when it is required to lock the valve timing INVT at the intermediate timing INVTmdl, the oil control valve 51 is maintained in the fourth mode to thereby make it possible to prevent a situation that the valve timing INVT is not locked by the intermediate locking mechanism 40 because of the rate of change at which the variable valve timing mechanism 30 is advanced. That is, it is possible to achieve both controlling the variable valve timing mechanism 30 and the intermediate locking mechanism 40 with the single oil control valve 51 and accurately locking the valve timing INVT with the intermediate locking mechanism 40.

A second embodiment of the variable valve timing apparatus for an internal combustion engine according to the aspect of the invention will be described with reference to FIG. 11A to FIG. 11D. Hereinafter, a modification from the configuration of the first embodiment will be described in detail, like reference numerals denote common components to those of the first embodiment, and the description thereof is omitted.

In the oil control valve 51 according to the first embodiment, the regulating valve 62 and the retard valve 63 are provided between the advance valve 61 and the first intermediate valve 64. In contrast, in the oil control valve 51 according to the present embodiment, a single valve element 67 is provided instead of the regulating valve 62 and the retard valve 63.

The operation modes of the oil control valve 51 will be described. As shown in FIG. 11A, when the position of the spool 60 with respect to the sleeve 70 is a first position, the operation mode is set to the first mode, and the following fluid communication state is maintained among the ports. That is, a fluid communication between the advance port 75 and the first drain port 73 is established, and a fluid communication between the advance port 75 and the first supply port 71 is shut off by the advance valve 61. In addition, a fluid communication between the retard port 76 and the first supply port 71 is established, and a fluid communication between the retard port 76 and the second drain port 74 is shut off by the valve element 67. In addition, a fluid communication between the intermediate port 77 and the second supply port 72 is established, and a fluid communication between the intermediate port 77 and the second drain port 74 is shut off by the first intermediate valve 64. Flow of lubricating oil in this case is substantially the same as that when the first mode is selected in the first embodiment.

As shown in FIG. 11B, when the position of the spool 60 with respect to the sleeve 70 is a second position, the operation mode is set to the second mode, and the following fluid communication state is maintained among the ports. That is, a fluid communication between the advance port 75 and the first supply port 71 is shut off by the advance valve 61, and a fluid communication between the advance port 75 and the first drain port 73 is shut off by the advance valve 61. In addition, a fluid communication between the retard port 76 and the first supply port 71 is shut off by the valve element 67, and a fluid communication between the retard port 76 and the second drain port 74 is shut off by the valve element 67. In addition, a fluid communication between the intermediate port 77 and the second supply port 72 is established, and a fluid communication between the intermediate port 77 and the second drain port 74 is shut off by the second intermediate valve 65. Flow of lubricating oil in this case is substantially the same as that when the second mode is selected in the first embodiment.

As shown in FIG. 11C, when the position of the spool 60 with respect to the sleeve 70 is a third position, the operation mode is set to the third mode, and the following fluid communication state is maintained among the ports. That is, a fluid communication between the advance port 75 and the first supply port 71 is established, and a fluid communication between the advance port 75 and the first drain port 73 is shut off by the advance valve 61. In addition, a fluid communication between the retard port 76 and the second drain port 74 is established, and a fluid communication between the retard port 76 and the first supply port 71 is shut off by the valve element 67. In addition, a fluid communication between the intermediate port 77 and the second supply port 72 is established, and a fluid communication between the intermediate port 77 and the second drain port 74 is shut off by the second intermediate valve 65. Flow of lubricating oil in this case is substantially the same as that when the third mode is selected in the first embodiment.

As shown in FIG. 11D, when the position of the spool 60 with respect to the sleeve 70 is a fourth position, the operation mode is set to the fourth mode, and the following fluid communication state is maintained among the ports. That is, a fluid communication between the advance port 75 and the first supply port 71 is established, and a fluid communication between the advance port 75 and the first drain port 73 is shut off by the advance valve 61. In addition, a fluid communication between the retard port 76 and the second drain port 74 is established, and a fluid communication between the retard port 76 and the first supply port 71 is shut off by the valve element 67. In addition, a fluid communication between the intermediate port 77 and the second drain port 74 is established via the intermediate communication passage 78, and a fluid communication between the intermediate port 77 and the second supply port 72 is shut off by the third intermediate valve 66. Flow of lubricating oil in this case is substantially the same as that when the fourth mode is selected in the first embodiment.

With the thus configured oil control valve 51, in the third mode, the variable valve timing mechanism 30 rotates in the timing advance direction and the state where lubricating oil is supplied to or drained from the intermediate locking mechanism 40 is maintained in the supply state, and, in the fourth mode, under a situation that the amount of lubricating oil supplied to the variable valve timing mechanism 30 is smaller than that in the third mode, the variable valve timing mechanism 30 rotates in the timing advance direction and the state where lubricating oil is supplied to or drained from the intermediate locking mechanism 40 is maintained in the drain state. Thus, a similar advantageous effect to that of the paragraph (1) according to the first embodiment may be obtained.

A third embodiment of the variable valve timing apparatus for an internal combustion engine according to the aspect of the invention will be described with reference to FIG. 12A to FIG. 12D. Hereinafter, a modification from the configuration of the first embodiment will be described in detail, like reference numerals denote common components to those of the first embodiment, and the description thereof is omitted.

The oil control valve 51 according to the first embodiment includes the spool 60 having six valve elements (the advance valve 61 to the third intermediate valve 66) and the sleeve 70 having two supply ports and two drain ports. In contrast, the oil control valve 51 according to the present embodiment includes a spool 80 and a sleeve 90. The spool 80 has six valve elements (a first valve element 81 to a sixth valve element 86) having different structures instead of the above six valve elements. The sleeve 90 has three supply ports and three drain ports. Note that the three supply ports (an advance supply port 91, a retard supply port 93 and an intermediate supply port 95) each are connected to the oil supply passage 53, and the three drain ports (an advance drain port 92, a retard drain port 94 and an intermediate drain port 96) each are connected to the oil drain passage 54.

The operation modes of the oil control valve 51 will be described. As shown in FIG. 12A, when the position of the spool 80 with respect to the sleeve 90 is a first position, the operation mode is set to the first mode, and the following fluid communication state is maintained among the ports. That is, a fluid communication between the advance port 97 and the advance drain port 92 is established, and a fluid communication between the advance port 97 and the advance supply port 91 is shut off by the second valve element 82. In addition, a fluid communication between the retard port 98 and the retard supply port 93 is established, and a fluid communication between the retard port 98 and the retard drain port 94 is shut off by the fourth valve element 84. In addition, a fluid communication between the intermediate port 99 and the intermediate supply port 95 is established, and a fluid communication between the intermediate port 99 and the intermediate drain port 96 is shut off by the fifth valve element 85. Flow of lubricating oil in this case is substantially the same as that when the first mode is selected in the first embodiment.

As shown in FIG. 12B, when the position of the spool 80 with respect to the sleeve 90 is a second position, the operation mode is set to the second mode, and the following fluid communication state is maintained among the ports. That is, a fluid communication between the advance port 97 and the advance supply port 91 is shut off by the second valve element 82, and a fluid communication between the advance port 97 and the advance drain port 92 is shut off by the second valve element 82. In addition, a fluid communication between the retard port 98 and the retard supply port 93 is shut off by the fourth valve element 84, and a fluid communication between the retard port 98 and the retard drain port 94 is shut off by the fourth valve element 84. In addition, a fluid communication between the intermediate port 99 and the intermediate supply port 95 is established, and a fluid communication between the intermediate port 99 and the intermediate drain port 96 is shut off by the fifth valve element 85. Flow of lubricating oil in this case is substantially the same as that when the second mode is selected in the first embodiment.

As shown in FIG. 12C, when the position of the spool 80 with respect to the sleeve 90 is a third position, the operation mode is set to the third mode, and the following fluid communication state is maintained among the ports. That is, a fluid communication between the advance port 97 and the advance supply port 91 is established, and a fluid communication between the advance port 97 and the advance drain port 92 is shut off by the second valve element 82. In addition, a fluid communication between the retard port 98 and the retard drain port 94 is established, and a fluid communication between the retard port 98 and the retard supply port 93 is shut off by the fourth valve element 84. In addition, a fluid communication between the intermediate port 99 and the intermediate supply port 95 is established, and a fluid communication between the intermediate port 99 and the intermediate drain port 96 is shut off by the fifth valve element 85. Flow of lubricating oil in this case is substantially the same as that when the third mode is selected in the first embodiment.

As shown in FIG. 12D, when the position of the spool 80 with respect to the sleeve 90 is a fourth position, the operation mode is set to the fourth mode, and the following fluid communication state is maintained among the ports. That is, a fluid communication between the advance port 97 and the advance supply port 91 is established, and a fluid communication between the advance port 97 and the advance drain port 92 is shut off by the second valve element 82. In addition, a fluid communication between the retard port 98 and the retard drain port 94 is established, and a fluid communication between the retard port 98 and the retard supply port 93 is shut off by the fourth valve element 84. In addition, a fluid communication between the intermediate port 99 and the intermediate drain port 96 is established, and a fluid communication between the intermediate port 99 and the intermediate supply port 95 is shut off by the sixth valve element 86. Flow of lubricating oil in this case is substantially the same as that when the fourth mode is selected in the first embodiment.

With the thus configured oil control valve 51, in the third mode, the variable valve timing mechanism 30 rotates in the timing advance direction, and the state where lubricating oil is supplied to or drained from the intermediate locking mechanism 40 is maintained in the supply state, and, in the fourth mode, under a situation that the amount of lubricating oil supplied to the variable valve timing mechanism 30 is smaller than that in the third mode, the variable valve timing mechanism 30 rotates in the timing advance direction, and the state where lubricating oil is supplied to or drained from the intermediate locking mechanism 40 is maintained in the drain state. Thus, a similar advantageous effect to that of the paragraph (1) according to the first embodiment may be obtained.

A fourth embodiment of the variable valve timing apparatus for an internal combustion engine according to the aspect of the invention will be described with reference to FIG. 13A to FIG. 13D. Hereinafter, a modification from the configuration of the first embodiment will be described in detail, like reference numerals denote common components to those of the first embodiment, and the description thereof is omitted.

In the variable valve timing mechanism 30 according to the present embodiment, a lock groove 45 that is continuous with the lock hole 44 is additionally formed in the housing 31 of the variable valve timing mechanism 30 according to the first embodiment.

The lock groove 45 is formed in the housing 31 so that the depth is smaller than that of the lock hole 44 and extends from the lock hole 44 to a predetermined position on the retard side of the lock hole 44 along the locus of the lock pin 41 in the circumferential direction. Then, the intermediate locking mechanism 40 includes the lock groove 45, so the lock pin 41 is fitted into the lock hole 44 in the following mode.

Figure 13A:
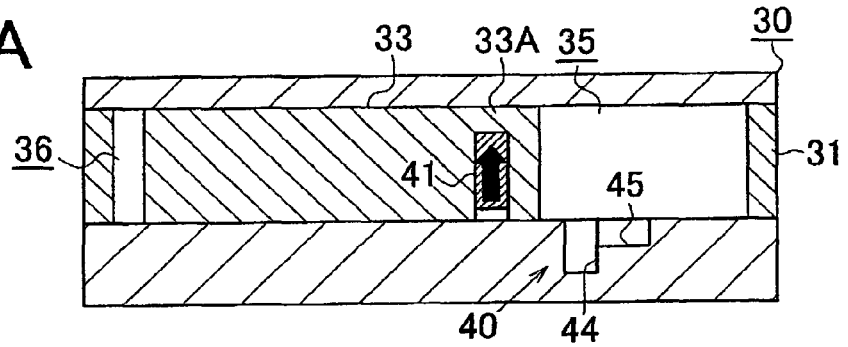
FIG. 13A to FIG. 13D are schematic views for which the cross-sectional structure of a variable valve timing mechanism of a variable valve timing apparatus for an internal combustion engine according to a fourth embodiment of the invention, taken along the Line A2-A2 in FIG. 2A, is developed on a plane.

As shown in FIG. 13A, in a state where a lock request is set during operation of the engine, when the rotational phase of the vane rotor 33 is advanced with respect to the intermediate phase PM, the rotational phase is changed to the retard side with respect to the intermediate phase PM.

Figure 13B:
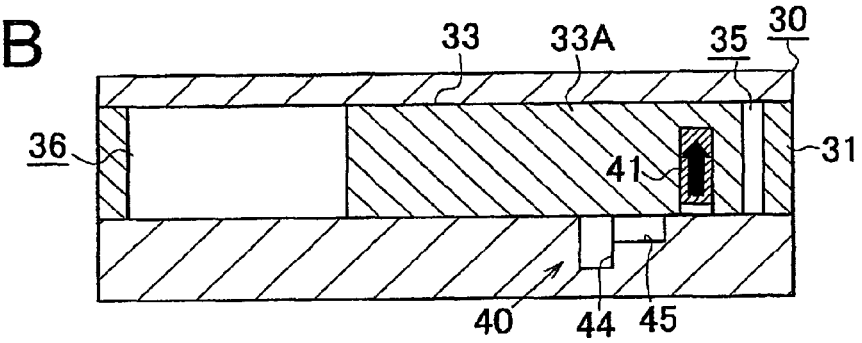

As shown in FIG. 13B, after the rotational phase of the vane rotor 33 is changed to the retard side with respect to the intermediate phase PM in response to the lock request, or when the rotational phase of the vane rotor 33 is already retarded with respect to the intermediate phase PM, the operation mode of the oil control valve 51 is changed to the fourth mode. Thus, lubricating oil smaller than that in the third mode is supplied to the advance chambers 35, and lubricating oil is drained from the retard chambers 36, and then the vane rotor 33 is actuated toward the advance side with respect to the housing 31. At this time, lubricating oil is drained from the intermediate chamber 42. Thus, force in the projecting direction ZA is exerted on the lock pin 41.

Figure 13C:
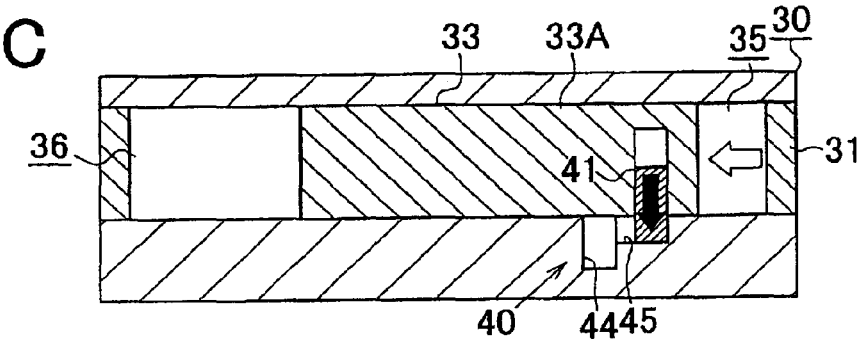

As shown in FIG. 13C, when the lock pin 41 is displaced to a position corresponding to the lock groove 45 as the vane rotor 33 is actuated toward the advance side, the lock pin 41 projects from the vane 33A and then the distal end of the lock pin 41 enters the lock groove 45. That is, as the rotational phase of the vane rotor 33 is changed from the rotational phase shown in FIG. 13B to the rotational phase shown in FIG. 13C, the distal end of the lock pin 41 is pressed against the bottom surface of the lock groove 45.

Then, under a situation that the distal end of the lock pin 41 is located in the lock groove 45, the oil control valve 51 is maintained in the fourth mode. By so doing, the lock pin 41 is displaced toward the advance side in the lock groove 45 as the vane rotor 33 is continuously actuated toward the advance side.

Figure 13D:
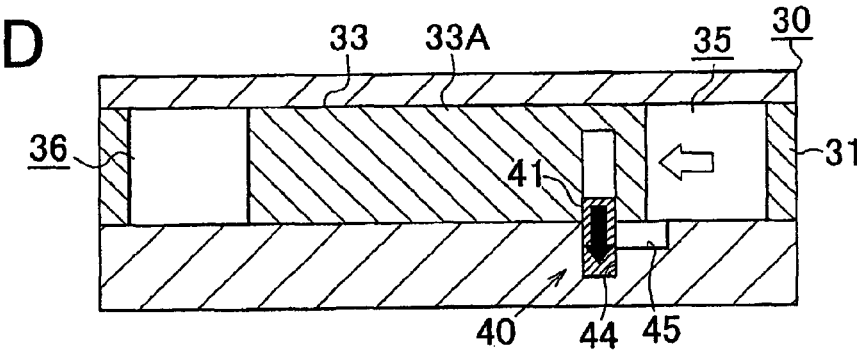

As shown in FIG. 13D, when the rotational phase of the vane rotor 33 with respect to the housing 31 reaches the intermediate phase PM, the side surface of the lock pin 41 is pressed against the wall surface that defines the lock hole 44, and then the lock pin 41 fully projects from the vane 33A and is fitted into the lock hole 44.

With the variable valve timing apparatus for an internal combustion engine according to the present embodiment, in addition to the advantageous effect of the paragraph (1) according to the first embodiment, the following advantageous effects may be further obtained.

(2) In the present embodiment, the lock groove 45 is provided, the lock groove 45 has an area larger than that of the lock hole 44, and the distal end of the lock pin 41 can be fitted into the lock groove 45.

With the above configuration, even under a situation that the relative rotational speed between the housing 31 and the vane rotor 33 is relatively large, the lock pin 41 is accurately fitted into the lock groove 45. In addition, the lock groove 45 is formed to be a space having a depth smaller than that of the lock hole 44. Thus, the side surface of the lock pin 41 that is displaced in the lock groove 45 toward the lock hole 44 is naturally pressed against the wall surface that defines the lock hole 44. That is, after the distal end of the lock pin 41 is fitted into the lock groove 45, even when the vane rotor 33 is actuated toward the retard side at any rate of change with respect to the housing 31, the lock pin 41 is prevented from passing by the lock hole 44. Thus, the lock pin 41 may be accurately fitted into the lock hole 44 through a contact between the side surface of the lock pin 41 and the side surface of the lock hole 44.

A fifth embodiment of the variable valve timing apparatus for an internal combustion engine according to the aspect of the invention will be described with reference to FIG. 14A to FIG. 16D. Hereinafter, a modification from the configuration of the first embodiment will be described in detail, like reference numerals denote common components to those of the first embodiment, and the description thereof is omitted.

With the oil control valve 51 according to the first embodiment, in the third mode, the variable valve timing mechanism 30 rotates in the timing advance direction and the state where lubricating oil is supplied to or drained from the intermediate locking mechanism 40 is maintained in the supply state, and, in the fourth mode, under a situation that the amount of lubricating oil is supplied to the advance chambers 35 of the variable valve timing mechanism 30 is smaller than that in the third mode, the variable valve timing mechanism 30 rotates in the timing advance direction and the state where lubricating oil is supplied to or drained from the intermediate locking mechanism 40 is maintained in the drain state. That is, both advance of the valve timing INVT and operation of the intermediate locking mechanism 40 in the projecting direction ZA are carried out together.

In contrast, in the oil control valve 151 according to the present embodiment, both retard of the valve timing INVT and operation of the intermediate locking mechanism 40 in the projecting direction ZA are carried out together. That is, in a seventh mode instead of the third mode, the variable valve timing mechanism 30 rotates in the timing retard direction and the state where lubricating oil is supplied to or drained from the intermediate locking mechanism 40 is maintained in the supply state, and, in an eighth mode instead of the fourth mode, under a situation that the amount of lubricating oil supplied to the retard chambers 36 of the variable valve timing mechanism 30 is smaller than that in the seventh mode, the variable valve timing mechanism 30 rotates in the timing retard direction and the state where lubricating oil is supplied to or drained from the intermediate locking mechanism 40 is maintained in the drain state.

Then, the thus configured modes are implemented by the oil control valve that employs a sleeve 170. The sleeve 170 has a structure such that the positions of the advance port and retard port are interchanged from those of the oil control valve 51 according to the first embodiment. Note that the other configuration of the oil control valve 151 is substantially similar to that of the oil control valve 51 according to the first embodiment.

The operation of the oil control valve 151 will be described with reference to FIG. 14A to FIG. 14D. As shown in FIG. 14A, when the position of a spool 160 with respect to the sleeve 170 is a fifth position, the operation mode is set to a fifth mode, and the following fluid communication state is maintained among the ports. That is, a fluid communication between a retard port 176 and a third drain port 173 is established, and a fluid communication between the retard port 176 and a third supply port 171 is shut off by a retard valve 161. In addition, a fluid communication between an advance port 175 and the third supply port 171 is established, and a fluid communication between the advance port 175 and a fourth drain port 174 is shut off by an advance valve 163. In addition, a fluid communication between an intermediate port 177 and a fourth supply port 172 is established, and a fluid communication between the intermediate port 177 and the fourth drain port 174 is shut off by a first intermediate valve 164.

As shown in FIG. 14B, when the position of the spool 160 with respect to the sleeve 170 is a sixth position, the operation mode is set to a sixth mode, and the following fluid communication state is maintained among the ports. That is, a fluid communication between the retard port 176 and the third supply port 171 is shut off by the retard valve 161, and a fluid communication between the retard port 176 and the third drain port 173 is shut off by the retard valve 161. In addition, a fluid communication between the advance port 175 and the third supply port 171 is shut off by the advance valve 163, and a fluid communication between the advance port 175 and the fourth drain port 174 is shut off by the advance valve 163. In addition, a fluid communication between the intermediate port 177 and the fourth supply port 172 is established, and a fluid communication between the intermediate port 177 and the fourth drain port 174 is shut off by a second intermediate valve 165.

As shown in FIG. 14C, when the position of the spool 160 with respect to the sleeve 170 is a seventh position, the operation mode is set to a seventh mode, and the following fluid communication state is maintained among the ports. That is, a fluid communication between the retard port 176 and the third supply port 171 is established, and a fluid communication between the retard port 176 and the third drain port 173 is shut off by the retard valve 161. In addition, a fluid communication between the advance port 175 and the fourth drain port 174 is established, and a fluid communication between the advance port 175 and the third supply port 171 is shut off by the advance valve 163. In addition, a fluid communication between the intermediate port 177 and the fourth supply port 172 is established, and a fluid communication between the intermediate port 177 and the fourth drain port 174 is shut off by the second intermediate valve 165.

As shown in FIG. 14D, when the position of the spool 160 with respect to the sleeve 170 is an eighth position, the operation mode is set to an eighth mode, and the following fluid communication state is maintained among the ports. That is, a fluid communication between the retard port 176 and the third supply port 171 is established, and a fluid communication between the retard port 176 and the third drain port 173 is shut off by the retard valve 161. In addition, a fluid communication between the advance port 175 and the fourth drain port 174 is established, and a fluid communication between the advance port 175 and the third supply port 171 is shut off by the advance valve 163. In addition, a fluid communication between the intermediate port 177 and the fourth drain port 174 is established via an intermediate communication passage 178, and a fluid communication between the intermediate port 177 and the fourth supply port 172 is shut off by a third intermediate valve 166.

As described above, the oil control valve 151 includes the sleeve 170 having the plurality of ports and the spool 160 having the plurality of valve elements, and the respective opening areas of the plurality of ports are varied by the corresponding valve elements among the plurality of valve elements as these sleeve 170 and spool 160 are relatively displaced.

In addition, in the seventh mode, among the plurality of ports, the retard port 176 connected to the retard chambers 36 of the variable valve timing mechanism 30 and the third supply port 171 connected to the lubricating oil supply source are in fluid communication with each other. Thus, a retard chamber flow passage 59 that supplies lubricating oil to the retard chambers 36 of the variable valve timing mechanism 30 is formed in the oil control valve 151.

In addition, in the eighth mode, among the plurality of ports, the retard port 176 connected to the retard chambers 36 of the variable valve timing mechanism 30 and the third supply port 171 connected to the lubricating oil supply source are in fluid communication with each other. Thus, the retard chamber flow passage 59 that supplies lubricating oil to the retard chambers 36 of the variable valve timing mechanism 30 is formed in the oil control valve 151.

Then, the opening area of the third supply port 171 in the eighth mode is smaller than the opening area of the third supply port 171 in the seventh mode, so the flow rate of lubricating oil in the retard chamber flow passage 59 in the eighth mode is lower than the flow rate of lubricating oil in the retard chamber flow passage 59 in the seventh mode. Thus, the amount of lubricating oil supplied to the retard chambers 36 in the eighth mode is smaller than the amount of lubricating oil supplied to the retard chambers 36 in the seventh mode, so the rate of change at which the variable valve timing mechanism 30 is retarded in the eighth mode is lower than the rate of change at which the variable valve timing mechanism 30 is retarded in the seventh mode.

That is, in the seventh mode, the variable valve timing mechanism 30 rotates in the timing retard direction and the state where lubricating oil is supplied to or drained from the intermediate locking mechanism 40 is maintained in the supply state, and, in the eighth mode, under a situation that the amount of lubricating oil supplied to the variable valve timing mechanism 30 is smaller than that in the seventh mode, the variable valve timing mechanism 30 rotates in the timing retard direction and the state where lubricating oil is supplied to or drained from the intermediate locking mechanism 40 is maintained in the drain state.

The relationship between the operation mode of the oil control valve 151 and the variable valve timing, mechanism 30 or the intermediate locking mechanism 40 and a mode in which the operation mode is set on the basis of an engine operating state, will be described with reference to FIG. 15A to FIG. 15C.

In the fifth mode, lubricating oil is supplied to the advance chambers 35, lubricating oil is drained from the retard chambers 36 and lubricating oil is supplied to the intermediate chamber 42. Thus, the variable valve timing mechanism 30 is actuated in the timing advance direction, and force in the accommodating direction ZB is exerted on the lock pin 41.

In the sixth mode, lubricating oil in the advance chambers 35 is held, lubricating oil in the retard chambers 36 is held and lubricating oil is supplied to the intermediate chamber 42. Thus, the operation state of the variable valve timing mechanism 30 is held, and force in the accommodating direction ZB is exerted on the lock pin 41.

In the seventh mode, lubricating oil is drained from the advance chambers 35, lubricating oil is supplied to the retard chambers 36 and lubricating oil is supplied to the intermediate chamber 42. Thus, the variable valve tithing mechanism 30 is actuated in the timing retard direction, and force in the accommodating direction ZB is exerted on the lock pin 41.

In the eighth mode, lubricating oil is drained from the advance chambers 35, lubricating oil is supplied to the retard chambers 36 at a flow rate that is lower than that in the seventh mode, and lubricating oil is drained from the intermediate chamber 42. Thus, the variable valve timing mechanism 30 is actuated in the timing retard direction at a rate of change lower than that in the seventh mode, and force in the projecting direction ZA is exerted on the lock pin 41.

As shown in FIG. 15C, the operation mode of the oil control valve 51 is changed as follows on the basis of an engine operating state. When the engine is started, that is, when there is a lock request, the operation mode is set to the eighth mode. In addition, when the lock request is cancelled, the operation mode is changed from the eighth mode to the sixth mode. In addition, when there is no lock request during operation of the engine, the operation mode is changed among the fifth mode, the sixth mode and the seventh mode in response to a request to change the valve timing INVT based on an engine operating state. In addition, when the engine is stopped or the engine is at idle, that is, when there is a lock request, the operation mode is changed from any one of the fifth mode, the sixth mode and the seventh mode to the eighth mode.

Note that, in the operation modes of the oil control valve 151 according to the present embodiment, the seventh mode may be regarded as a fourth operation mode according to the aspect of the invention, the eighth mode may be regarded as a fifth operation mode according to the aspect of the invention and the fifth mode may be regarded as a sixth operation mode according to the aspect of the invention.

An example of an operation mode of the intermediate locking mechanism 40 for locking the valve timing INVT at the intermediate timing INVTmdl will be described with reference to FIG. 16A to FIG. 16D. Under a situation that a lock request is set, when it is determined that the rotational phase of the vane rotor 33 is retarded with respect to the intermediate phase PM, that is, for example, the above rotational phase is the rotational phase shown in FIG. 16A, the operation mode of the oil control valve 151 is changed to the fifth mode. Thus, the vane rotor 33 is actuated toward the advance side.

Figure 16A:
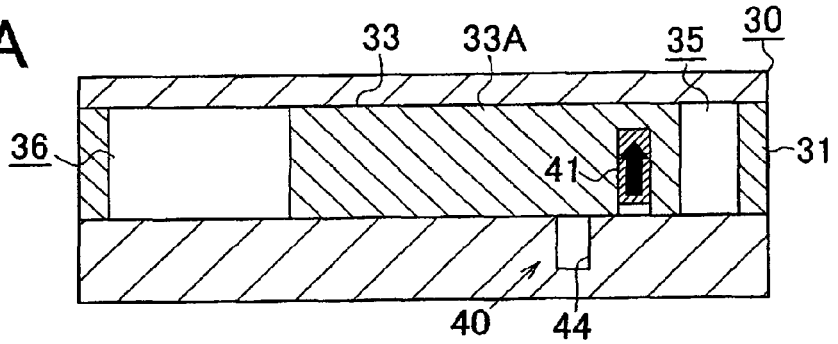
FIG. 16A to FIG. 16D are schematic views for which the cross-sectional structure of the variable valve timing mechanism according to the fifth embodiment, taken along the line A2-A2 in FIG. 2A, is developed on a plane.
Figure 16B:
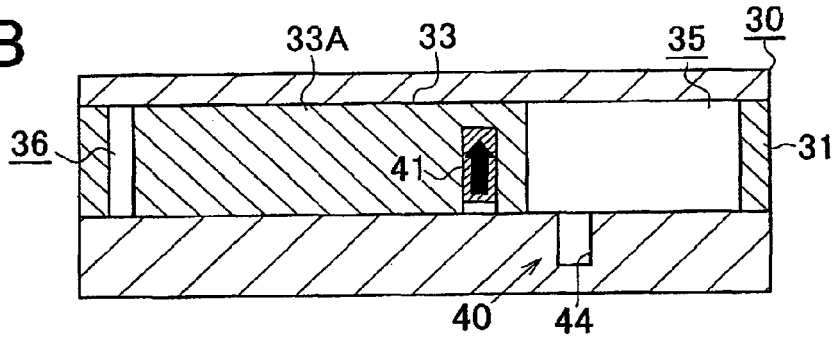
Figure 16C:
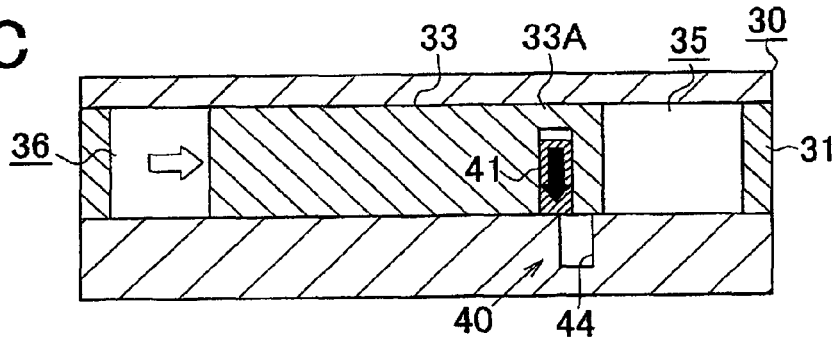
Figure 16D:
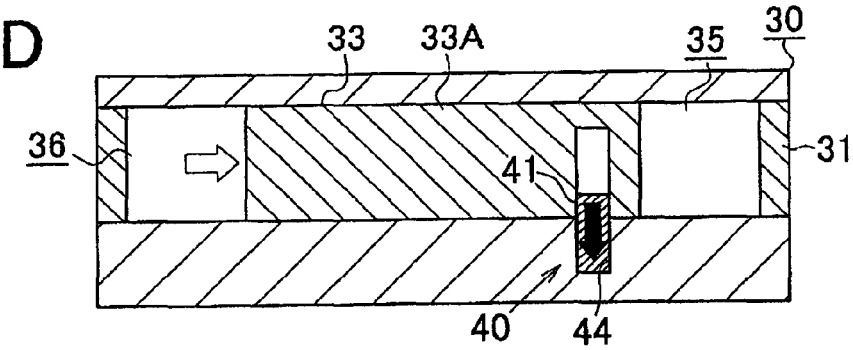

When it is determined that the rotational phase of the vane rotor 33 is advanced with respect to the intermediate phase PM, that is, for example, the above rotational phase is the rotational phase shown in FIG. 16B, the operation mode of the oil control valve 151 is changed to the eighth mode. By so doing, lubricating oil is drained from the advance chambers 35, and lubricating oil is supplied to the retard chambers 36, and then the vane rotor 33 is actuated with respect to the housing 31 toward a retard side at a rate of change lower than that in the seventh mode as shown in FIG. 16C. In addition, at this time, lubricating oil is drained from the intermediate chamber 42, so force in the projecting direction ZA is exerted on the lock pin 41. Therefore, when the lock pin 41 is displaced to a position corresponding to the lock hole 44 as the vane rotor 33 is actuated toward the retard side, the lock pin 41 is inserted into the lock hole 44 as shown in FIG. 16D. Thus, the rotational phase of the vane rotor 33 with respect to the housing 31 is locked at the intermediate phase PM.

After the lock pin 41 is fitted in the lock hole 44, as long as the lock request is continuously set, the oil control valve 151 is maintained in the fourth mode. Therefore, force that actuates the vane rotor 33 toward the retard side is continuously exerted by lubricating oil in the retard chambers 36. That is, the lock pin 41 is maintained in a state where the side surface of the lock pin 41 is pressed against the wall surface that defines the lock hole 44.

On the other hand, when the lock request is cancelled, the operation mode of the oil control valve 151 is changed to the sixth mode to thereby withdraw the lock pin 41 from the lock hole 44. After that, the seventh mode is selected when there is a request to retard the valve timing INVT, the fifth mode is selected when there is a request to advance the valve timing INVT, and the sixth mode is selected when there is a request to hold the valve timing INVT.

With the variable valve timing apparatus for an internal combustion engine according to the present embodiment, the following advantageous effects may be obtained.

(1) In the present embodiment, the state where lubricating oil is supplied to or drained from each of the variable valve timing mechanism 30 and the intermediate locking mechanism 40 is controlled by the single oil control valve 151. Then, in the seventh mode, the oil control valve 151 actuates the variable valve timing mechanism 30 in the timing retard direction and maintains the state, where lubricating oil is supplied to or drained from the intermediate locking mechanism 40, in the supply state. In the eighth mode, the oil control valve 151 actuates the variable valve timing mechanism 30 in the timing retard direction under a situation that the amount of lubricating oil supplied to the variable valve timing mechanism 30 is smaller than that in the seventh mode and maintains the state, where lubricating oil is supplied to or drained from the intermediate locking mechanism 40, in the drain state.

With the above configuration, the above seventh mode and eighth mode are prepared as the operation mode of the oil control valve 151. Therefore, when it is required to lock the valve timing INVT at the intermediate timing INVTmdl, the oil control valve 151 is maintained in the eighth mode to thereby make it possible to prevent a situation that the valve timing INVT is not locked by the intermediate locking mechanism 40 because of the rate of change at which the variable valve timing mechanism 30 is retarded. That is, it is possible to achieve both controlling the variable valve timing mechanism 30 and the intermediate locking mechanism 40 with the single oil control valve 151 and accurately locking the valve timing INVT with the intermediate locking mechanism 40.

Note that the aspect of the invention is not limited to the above illustrated embodiments; the embodiments may be, for example, modified into the following alternative embodiments. In addition, the following alternative embodiments are not only applied to the above embodiments, and the different alternative embodiments may be implemented in combination with each other.

In the first embodiment, the oil control valve 51 is configured so that the opening area of the advance chamber flow passage 58 in the fourth mode is smaller than that in the third mode to thereby decrease the flow rate of lubricating oil to the advance chambers 35 in the fourth mode as compared with the flow rate in the third mode; however, a configuration for implementing the above function is not limited to this configuration. For example, it is also applicable that the advance chamber flow passage 58 is closed in the fourth mode to thereby decrease the flow rate of lubricating oil to the advance chambers 35 in the fourth mode as compared with the flow rate in the third mode. Alternatively, the thus modified mode may be additionally provided as a mode different from the preset fourth mode.

In the fifth embodiment, the oil control valve 151 is configured so that the opening area of the retard chamber flow passage 59 in the eighth mode is smaller than that in the seventh mode to thereby decrease the flow rate of lubricating oil to the retard chambers 36 in the eighth mode as compared with the flow rate in the seventh mode; however, a configuration for implementing the above function is not limited to this configuration. For example, it is also applicable that the retard chamber flow passage 59 is closed in the eighth mode to thereby decrease the flow rate of lubricating oil to the retard chambers 36 as compared with the flow rate in the seventh mode. In addition, the thus modified mode may be additionally provided as a mode different from the preset eighth mode.

In each of the embodiments, when the hydraulic pressure in the intermediate chamber 42, applied to the lock pin 41, is released, the lock pin 41 is maintained in a state where the lock pin 41 can project from the vane 33A; instead, the relationship between the intermediate chamber 42 and the lock spring 43 may be opposite to those of the above embodiments. That is, it may be modified into a configuration such that the lock pin 41 is actuated in the projecting direction by the hydraulic pressure in the intermediate chamber 42 and the lock pin 41 is actuated in the accommodating direction by the force of the lock spring 43.

In each of the above embodiments, the intermediate locking mechanism 40 is configured so that the lock pin 41, and the like, is provided for the vane rotor 33 that serves as an accommodating rotor and the lock hole 44 is provided for the housing 31 that serves as an engaged rotor; however, the configuration of the intermediate locking mechanism 40 is not limited to this configuration. For example, it is also applicable that the lock pin 41, and the like, is provided for the housing 31 and the lock hole 44 is provided for the vane rotor 33.

In each of the embodiments, the aspect of the invention is applied to the variable valve timing apparatus that includes the variable valve timing mechanism 30 of the intake valve 21; instead, the aspect of the invention may also be applied to a variable valve timing apparatus that includes a variable valve timing mechanism of the exhaust valve 23 in an embodiment similar to the above embodiments.

The configuration of the variable valve timing apparatus, which is an application target of the aspect of the invention, including the configuration of the variable valve timing mechanism 30 and the configuration of the intermediate locking mechanism 40, is not limited to the configurations described in the above embodiments. In short, as long as a variable valve timing apparatus includes a variable valve timing mechanism that changes the valve timing, an intermediate locking mechanism that locks the valve timing at a specific intermediate timing and a hydraulic pressure control mechanism that uses an oil control valve to control a state where lubricating oil is supplied to or drained from each of these mechanisms, the aspect of the invention may be applied to any variable valve timing apparatus. In that case as well, function and advantageous effects similar to the function and advantageous effects of the above embodiments may be obtained.

The invention claimed is:

1. A method of controlling a variable valve timing apparatus for an internal combustion engine, the variable valve timing apparatus including: (i) a sprocket-rotor type variable valve timing mechanism, (ii) a spring-actuated phase locking mechanism, (iii) an oil-controlled hydraulic pressure control mechanism, and (iv) an electronic control unit, the method of controlling the variable valve timing apparatus comprising:

in a third operation mode where the engine is operating in a normal operation state:

actuating, by a single control valve, the variable valve timing mechanism in a timing advance direction, the variable valve timing mechanism being configured to change a valve timing of an engine valve between a most advanced timing and a most retarded timing, the single control valve being configured to control a state where working fluid is supplied to or drained from each of an advance chamber of the variable valve timing mechanism, a retard chamber of the variable valve timing mechanism and the phase locking mechanism; and maintaining a second supply/drain state by supplying working oil to the phase locking mechanism such that the phase locking mechanism is in a release position, the phase locking mechanism being configured to lock the valve timing of the engine valve at an intermediate timing between the most advanced timing and the most retarded timing, the phase locking mechanism being displaced in the release position to unlock the valve timing when: (1) the valve timing is at the intermediate timing, and (2) the working oil supplied or drained by the hydraulic pressure control mechanism is in the second supply/drain state, the hydraulic pressure control mechanism being configured to hydraulically actuate the variable valve timing mechanism and the phase locking mechanism; and in a fourth operation mode where the engine operates at an idle or stopped state, in response to a first amount of working oil supplied to the advance chamber of the variable valve timing mechanism being smaller than a second amount of working oil supplied to the variable valve timing mechanism in the third operation mode:

actuating, by the single control valve, the variable valve timing mechanism in the timing advance direction;

maintaining a first supply/drain state by draining working oil from the phase locking mechanism so that the phase locking mechanism is in a lock position, the phase locking mechanism being displaced in the lock position to lock the valve timing when: (1) the valve timing is at the intermediate timing, and (2) a working oil supplied to or drained from the phase locking mechanism by the hydraulic pressure control mechanism is in the first supply/drain state;

controlling, by the single control valve, a flow rate of a supply of the first amount of working oil at a lower flow rate in the fourth operation mode than a flow rate in the third operation mode; and actuating, by the single control valve, the variable valve timing mechanism at a lower rotational rate of change in the fourth operation mode than in the third operation mode.

2. The method for controlling the variable valve timing apparatus according to claim 1, wherein the engine valve is one of an intake valve and an exhaust valve.

3. The method for controlling the variable valve timing apparatus according to claim 1, further comprising:

forming an advance chamber flow passage supplying working oil to the advance chamber of the variable valve timing mechanism in the single control valve in any one of the third operation mode and the fourth operation mode, wherein a flow rate of working oil in the advance chamber flow passage formed in the fourth operation mode is lower than a flow rate of working oil in the advance chamber flow passage formed in the third operation mode, whereby an amount of working oil supplied to the advance chamber of the variable valve timing mechanism is varied between the third operation mode and the fourth operation mode.

4. The method for controlling the variable valve timing apparatus according to claim 3, wherein:

the single control valve includes a sleeve having a plurality of ports and a spool having a plurality of valve elements, and respective opening areas of the plurality of ports are varied by the corresponding valve elements among the plurality of valve elements as the sleeve and the spool are relatively displaced;

in any one of the third operation mode and the fourth operation mode, among the plurality of ports, an advance port that is connected to the advance chamber of the variable valve timing mechanism and a supply port that supplies working oil are in fluid communication with each other; and an opening area of one of the advance port and the supply port in the fourth operation mode is smaller than an opening area of one of the advance port and the supply port in the third operation mode, whereby a flow rate of working fluid in the advance chamber flow passage is varied between the third operation mode and the fourth operation mode.

5. The method for controlling the variable valve timing apparatus according to claim 1, further comprising in a first operation mode:

actuating, by the single control valve, the variable valve timing mechanism in a timing retard direction;

maintaining the second supply/drain state by supplying working oil to the phase locking mechanism;

when there is a request to lock the valve timing at the intermediate timing and the valve timing at that time is advanced with respect to the intermediate timing, maintaining an operation mode of the single control valve in the first operation mode to change the valve timing to be retarded with respect to the intermediate timing; and maintaining the operation mode of the single control valve in the fourth operation mode to advance the valve timing.

6. The method for controlling the variable valve timing apparatus according to claim 1, further comprising:

when there is a request to lock the valve timing at the intermediate timing and the valve timing at that time is retarded with respect to the intermediate timing, maintaining an operation mode of the single control valve in the fourth operation mode to advance the valve timing.

7. The method for controlling the variable valve timing apparatus according to claim 1, further comprising:

adjusting, by the variable valve timing mechanism, a relative phase that is a relative rotational phase between an input rotor that rotates in conjunction with a crankshaft and an output rotor that rotates in conjunction with a camshaft of the engine valve to thereby change the valve timing, wherein:

the phase locking mechanism includes a restricting member that is provided for an accommodating rotor, which is one of the input rotor and the output rotor, and that is displaced between the lock position and the release position with respect to the accommodating rotor and a restricting hole that is provided for an engaged rotor, which is the other one of the input rotor and the output rotor, and into which the restricting member is fitted; and when the relative phase is an intermediate phase corresponding to the intermediate timing and the state where working oil is supplied or drained by the hydraulic pressure control mechanism is the first supply/drain state, the restricting member is displaced to the lock position to be fitted into the restricting hole to thereby lock the valve timing at the intermediate timing, and, when the relative phase is the intermediate phase corresponding to the intermediate timing and the state where working oil is supplied or drained by the hydraulic pressure control mechanism is the second supply/drain state, the restricting member is displaced to the release position to be withdrawn from the restricting hole to thereby unlock the valve timing from the intermediate timing.

8. The method of controlling the variable valve timing apparatus according to claim 7, wherein the engaged rotor has a restricting groove that is continuous with the restricting the restricting groove having a depth smaller than that of the restricting hole, the restricting groove extends from the restricting hole to a predetermined position on a retard side of the restricting hole along a locus of the restricting member.

9. A method of controlling a variable valve timing apparatus for an internal combustion engine, the variable valve timing apparatus including: (i) a sprocket-rotor type variable valve timing mechanism, (ii) a spring-actuated phase locking mechanism, (iii) an oil-controlled hydraulic pressure control mechanism, and (iv) an electronic control unit, the method of controlling the variable valve timing apparatus comprising:

in a seventh operation mode where the engine is operating in a normal operation state:

actuating, by a single control valve, the variable valve timing mechanism in a timing retard direction, the variable valve timing mechanism being configured to change a valve timing of an engine valve between a most advanced timing and a most retarded timing, the single control valve being configured to control a state where working fluid is supplied to or drained from each of an advance chamber of the variable valve timing mechanism, a retard chamber of the variable valve timing mechanism and the phase locking mechanism; and maintaining a second supply/drain state by supplying working oil to the phase locking mechanism such that the phase locking mechanism is in a release position, the phase locking mechanism being configured to lock the valve timing of the engine valve at an intermediate timing between the most advanced timing and the most retarded timing, the phase locking mechanism being displaced in the release position to unlock the valve timing when: (1) the valve timing is at the intermediate timing, and (2) the working oil supplied or drained by the hydraulic pressure control mechanism is in the second supply/drain state, the hydraulic pressure control mechanism being configured to hydraulically actuate the variable valve timing mechanism and the phase locking mechanism; and in an eighth operation mode where the engine operates at an idle or stopped state, in response to a first amount of working oil supplied to the advance chamber of the variable valve timing mechanism being smaller than a second amount of working oil supplied to the variable valve timing mechanism in the third operation mode:

actuating, by the single control valve, the variable valve timing mechanism in the timing retard direction;

maintaining a first supply/drain state by draining working oil from the phase locking mechanism so that the phase locking mechanism is in a lock position, the phase locking mechanism being displaced in the lock position to lock the valve timing when: (1) the valve timing is at the intermediate timing, and (2) a working oil supplied to or drained from the phase locking mechanism by the hydraulic pressure control mechanism is in the first supply/drain state;

controlling, by the single control valve, a flow rate of a supply of the first amount of working oil at a lower flow rate in the eighth operation mode than a flow rate in the seventh operation mode; and actuating, by the single control valve, the variable valve timing mechanism at a lower rotational rate of change in the eighth operation mode than in the seventh operation mode.

10. The method of controlling the variable valve timing apparatus according to claim 9, wherein the engine valve is one of an intake valve and an exhaust valve.

11. The method of controlling the variable valve timing apparatus according to claim 9, further comprising:

forming a retard chamber flow passage supplying working oil to the retard chamber of the variable valve timing mechanism in the single control valve in any one of the seventh operation mode and the eighth operation mode, wherein a flow rate of working oil in the retard chamber flow passage formed in the eighth operation mode is lower than a flow rate of working oil in the retard chamber flow passage formed in the seventh operation mode, whereby an amount of working oil supplied to the retard chamber of the variable valve timing mechanism is varied between the seventh operation mode and the eighth operation mode.

12. The method of controlling the variable valve timing apparatus according to claim 11, wherein:

the single control valve includes a sleeve having a plurality of ports and a spool having a plurality of valve elements, and respective opening areas of the plurality of ports are varied by the corresponding valve elements among the plurality of valve elements as the sleeve and the spool are relatively displaced;

in any one of the seventh operation mode and the eighth operation mode, among the plurality of ports, a retard port that is connected to the retard chamber of the variable valve timing mechanism and a supply port that supplies working oil are in fluid communication with each other; and an opening area of one of the retard port and the supply port in the eighth operation mode is smaller than an opening area of one of the retard port and the supply port in the seventh operation mode, whereby a flow rate of working fluid in the retard chamber flow passage is varied between the seventh operation mode and the eighth operation mode.

13. The method of controlling the variable valve timing apparatus according to claim 9, further comprising in a fifth operation mode:

actuating, by the single control valve, the variable valve timing mechanism in a timing advance direction, maintaining the second supply/drain state by supplying working oil to the phase locking mechanism;

when there is a request to lock the valve timing at the intermediate timing and the valve timing at that time is retarded with respect to the intermediate timing, maintaining an operation mode of the single control valve in the fifth operation mode to change the valve timing to be advanced with respect to the intermediate timing; and maintaining the operation mode of the single control valve in the eighth operation mode to retard the valve timing.

14. The method of controlling the variable valve timing apparatus according to claim 9, further comprising:

when there is a request to lock the valve timing at the intermediate timing and the valve timing at that time is advanced with respect to the intermediate timing, maintaining an operation mode of the single control valve in the eighth operation mode to retard the valve timing.

15. The method of controlling the variable valve timing apparatus according to claim 9, further comprising:

adjusting, by the variable valve timing mechanism, a relative phase that is a relative rotational phase between an input rotor that rotates in conjunction with a crankshaft and an output rotor that rotates in conjunction with a camshaft of the engine valve to thereby change the valve timing, wherein:

the phase locking mechanism includes a restricting member that is provided for an accommodating rotor, which is one of the input rotor and the output rotor, and that is displaced between the lock position and the release position with respect to the accommodating rotor and a restricting hole that is provided for an engaged rotor, which is the other one of the input rotor and the output rotor, and into which the restricting member is fitted, and when the relative phase is an intermediate phase corresponding to the intermediate timing and the state where working oil is supplied or drained by the hydraulic pressure control mechanism is the first supply/drain state, the restricting member is displaced to the lock position to be fitted into the restricting hole to thereby lock the valve timing at the intermediate timing, and, when the relative phase is the intermediate phase corresponding to the intermediate timing and the state where working oil is supplied or drained by the hydraulic pressure control mechanism is the second supply/drain state, the restricting member is displaced to the release position to be withdrawn from the restricting hole to thereby unlock the valve timing from the intermediate timing.

16. A method of controlling a variable valve timing apparatus for an internal combustion engine, the variable valve timing apparatus including: (i) a sprocket-rotor type variable valve timing mechanism, (ii) a spring-actuated phase locking mechanism, (iii) an oil-controlled hydraulic pressure control mechanism, and (iv) an electronic control unit, the method of controlling the variable valve timing apparatus comprising:

in a third operation mode where the engine is operating in a normal operation state:

rotating the variable valve timing mechanism in a timing advance direction, the variable valve timing mechanism being configured to change a valve timing of an engine valve between a most advanced timing and a most retarded timing; and supplying working oil to the phase locking mechanism so that the phase locking mechanism is in a release position, the phase locking mechanism being configured to lock the valve timing of the engine valve at an intermediate between the most advanced timing and the most retarded timing, wherein the intermediate timing is a phase in a variable range of the valve timing excluding both ends of the variable range, the phase locking mechanism being displaced in the release position to unlock the valve timing when: (1) the valve timing is at the intermediate timing, and (2) a working oil supplied or drained by the hydraulic pressure control mechanism is in a second supply/drain state, the hydraulic pressure control mechanism being configured to hydraulically actuate the variable valve timing mechanism and the phase locking mechanism; and in a fourth operation mode where the engine is operating in an idle or stopped state:

rotating the variable valve timing mechanism in the timing advance direction;

draining working oil from the phase locking mechanism so that the phase locking mechanism is in a lock position, the phase locking mechanism being displaced in the lock position to lock the valve timing when: (1) the valve timing is at the intermediate timing, and (2) the working oil supplied to or drained from the phase locking mechanism by the hydraulic pressure control mechanism is in a first supply/drain state;

controlling, by a single control valve, a flow rate of a supply of working oil at a lower flow rate in the fourth operation mode than a flow rate in the third operation mode, the single control valve being configured to control a state where working fluid is supplied to or drained from each of an advance chamber of the variable valve timing mechanism, a retard chamber of the variable valve timing mechanism and the phase locking mechanism, the single control valve including a sleeve having a plurality of ports and a spool having a plurality of valve elements, the plurality of ports having respective opening areas varied by the corresponding valve elements among the plurality of valve elements as the sleeve and the spool are relatively displaced; and actuating the variable valve timing mechanism at a lower rotational rate of change in the fourth operation mode than in the third operation mode, wherein:

in any of the third operation mode and the fourth operation mode, an advance port connected to: (i) the advance chamber of the variable valve timing mechanism, and (ii) a supply port that supplies working oil are in fluid communication with each other; and an opening area of one of the advance port and the supply port in the fourth operation mode is smaller than an opening area of one of the advance port and the supply port in the third operation mode.

17. A method of controlling a variable valve timing apparatus for an internal combustion engine, the variable valve timing apparatus including: (i) a sprocket-rotor type variable valve timing mechanism, (ii) a spring-actuated phase locking mechanism, (iii) an oil-controlled hydraulic pressure control mechanism, and (iv) an electronic control unit, the method of controlling the variable valve timing apparatus comprising:

in a seventh operation mode where the engine is operating in a normal operation state:

rotating the variable valve timing mechanism in a timing retard direction, the variable valve timing mechanism being configured to change a valve timing of an engine valve between a most advanced timing and a most retarded timing; and supplying working oil to the phase locking mechanism so that the phase locking mechanism is in a release position, the phase locking mechanism being configured to lock the valve timing of the engine valve at an intermediate timing between the most advanced timing and the most retarded timing, wherein the intermediate timing is a phase in a variable range of the valve timing excluding both ends of the variable range, the phase locking mechanism being displaced in the release position to unlock the valve timing when: (1) the valve timing is at the intermediate timing, and (2) a working oil supplied or drained by the hydraulic pressure control mechanism is in a second supply/drain state, the hydraulic pressure control mechanism being configured to hydraulically actuate the variable valve timing mechanism and the phase locking mechanism; and in an eighth operation mode where the engine is operating in an idle or stopped state:

rotating the variable valve timing mechanism in the timing retard direction;

draining working oil from the phase locking mechanism so that the phase locking mechanism is in a lock position, the phase locking mechanism being displaced in the lock position to lock the valve timing when: (1) the valve timing is at the intermediate timing, and (2) the working oil supplied to or drained from the phase locking mechanism by the hydraulic pressure control mechanism is in a first supply/drain state;

controlling, by a single control valve, a flow rate of a supply of working oil at a lower flow rate in the eighth operation mode than a flow rate in the seventh operation mode, the single control valve being configured to control a state where working fluid is supplied to or drained from each of an advance chamber of the variable valve timing mechanism, a retard chamber of the variable valve timing mechanism and the phase locking mechanism, the single control valve including a sleeve having a plurality of ports and a spool having a plurality of valve elements, the plurality of ports having respective opening areas varied by the corresponding valve elements among the plurality of valve elements as the sleeve and the spool are relatively displaced; and actuating the variable valve timing mechanism at a lower rotational rate of change in the eighth operation mode than in the seventh operation mode, wherein:

in any of the seventh operation mode and the eighth operation mode, a retard port connected to: (i) the retard chamber of the variable valve timing mechanism, and (ii) a supply port that supplies working oil are in fluid communication with each other; and an opening area of one of the retard port and the supply port in the eighth operation mode is smaller than an opening area of one of the retard port and the supply port in the seventh operation mode.

18. A method of controlling a variable valve timing apparatus for an internal combustion engine, the variable valve timing apparatus including: (i) a sprocket-rotor type variable valve timing mechanism, (ii) a spring-actuated phase locking mechanism, (iii) an oil-controlled hydraulic pressure control mechanism, and (iv) an electronic control unit, the method of controlling the variable valve timing apparatus comprising:

in a third operation mode where the engine is operating in a normal operation state:

actuating, by a single control valve, the variable valve timing mechanism in a timing advance direction, the variable valve timing mechanism being configured to change a valve timing of an engine valve between a most advanced timing and a most retarded timing, the single control valve being configured to control a state where working fluid is supplied to or drained from each of an advance chamber of the variable valve timing mechanism, a retard chamber of the variable valve timing mechanism and the phase locking mechanism; and maintaining a second supply/drain state by supplying working oil to the phase locking mechanism such that the phase locking mechanism is in a release position, the phase locking mechanism being configured to lock the valve timing of the engine valve at an intermediate timing between the most advanced timing and the most retarded timing, wherein the intermediate timing is a phase in a variable range of the valve timing excluding both ends of the variable range, the phase locking mechanism being displaced in the release position to unlock the valve timing when: (1) the valve timing is at the intermediate timing, and (2) a working oil supplied or drained by the hydraulic pressure control mechanism is in a second supply/drain state, the hydraulic pressure control mechanism being configured to hydraulically actuate the variable valve timing mechanism and the phase locking mechanism; and in a fourth operation mode where the engine is operating in an idle or stopped state, in response to a rate of change of an advancement of the variable valve timing mechanism being lower than that in the third operation mode:

actuating, by the single control valve, the variable timing mechanism in the timing advance direction;

maintaining a first supply/drain state by draining working oil from the phase locking mechanism so that the phase locking mechanism is in a lock position, the phase locking mechanism being displaced in the lock position to lock the valve timing when: (1) the valve timing is at the intermediate timing, and (2) the working oil supplied to or drained from the phase locking mechanism by the hydraulic pressure control mechanism is in a first supply/drain state;

controlling, by the single control valve, a flow rate of a supply of working oil at a lower flow rate in the fourth operation mode than a flow rate in the third operation mode; and actuating, by the single control valve, the variable valve timing mechanism at a lower rotational rate of change in the fourth operation mode than in the third operation mode.

19. A method of controlling a variable valve timing apparatus for an internal combustion engine, the variable valve timing apparatus including: (i) a sprocket-rotor type variable valve timing mechanism, (ii) a spring-actuated phase locking mechanism, (iii) an oil-controlled hydraulic pressure control mechanism, and (iv) an electronic control unit, the method of controlling the variable valve timing apparatus comprising:

in a seventh operation where the engine is operating in a normal operation state:

actuating, by a single control valve, the variable valve timing mechanism in a timing retard direction, the variable valve timing mechanism being configured to change a valve timing of an engine valve between a most advanced timing and a most retarded timing, the single control valve being configured to control a state where working fluid is supplied to or drained from each of an advance chamber of the variable valve timing mechanism, a retard chamber of the variable valve timing mechanism and the phase locking mechanism; and maintaining a second supply/drain state by supplying working oil to the phase locking mechanism such that the phase locking mechanism is in a release position, the phase locking mechanism being configured to lock the valve timing of the engine valve at an intermediate timing between the most advanced timing and the most retarded timing, wherein the intermediate timing is a phase in a variable range of the valve timing excluding both ends of the variable range, the phase locking mechanism being displaced in the release position to unlock the valve timing when: (1) the valve timing is at the intermediate timing, and (2) a working oil supplied or drained by the hydraulic pressure control mechanism is in a second supply/drain state, the hydraulic pressure control mechanism being configured to hydraulically actuate the variable valve timing mechanism and the phase locking mechanism; and in the eighth operation mode where the engine is operating in an idle or stopped state, in response to a rate of change of the retardation of the variable valve timing mechanism being lower than that in the seventh operation mode:

actuating, by the single control valve, the variable timing mechanism in the timing retard direction;

maintaining a first supply/drain state by draining working oil from the phase locking mechanism so that the phase locking mechanism is in a lock position, the phase locking mechanism being displaced in the lock position to lock the valve timing when: (1) the valve timing is at the intermediate timing, and (2) the working oil supplied to or drained from the phase locking mechanism by the hydraulic pressure control mechanism is in a first supply/drain state;

controlling, by the single control valve, a flow rate of a supply of working oil at a lower flow rate in the eighth operation mode than a flow rate in the seventh operation mode; and actuating, by the single control valve, the variable valve timing mechanism at a lower rotational rate of change in the eighth operation mode than in the seventh operation mode.

* * * * *